US009019326B2

(12) United States Patent
Yatabe

(10) Patent No.: US 9,019,326 B2
(45) Date of Patent: Apr. 28, 2015

(54) ELECTRO-OPTIC APPARATUS, DRIVING METHOD THEREFOR, AND ELECTRONICS DEVICE

(71) Applicant: Seiko Epson Corporation, Tokyo (JP)

(72) Inventor: Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

(21) Appl. No.: 14/015,786

(22) Filed: Aug. 30, 2013

(65) Prior Publication Data

US 2014/0085347 A1 Mar. 27, 2014

(30) Foreign Application Priority Data

Sep. 21, 2012 (JP) ..... 2012-207892

(51) Int. Cl.
*G09G 3/36* (2006.01)

(52) U.S. Cl.
CPC ..... *G09G 3/3677* (2013.01)

(58) Field of Classification Search
CPC . G09G 3/3611; G09G 3/3677; G09G 3/3659; G09G 3/3688; G09G 3/3266; G09G 3/3275; G09G 2320/0209; G09G 2320/0257; G09G 2310/067; G09G 2310/021; G09G 2310/0254; G09G 2310/0213; G09G 2300/0823
USPC ..... 345/89, 690
See application file for complete search history.

(56) References Cited

U.S. PATENT DOCUMENTS

2010/0053055 A1* 3/2010 Tsai ..... 345/94
2010/0295837 A1* 11/2010 Yoshinaga et al. ..... 345/211
2010/0315400 A1* 12/2010 Choi et al. ..... 345/211
2011/0018859 A1* 1/2011 Ito ..... 345/213
2011/0310135 A1* 12/2011 Feng ..... 345/690
2012/0176375 A1* 7/2012 Ito ..... 345/419

FOREIGN PATENT DOCUMENTS

JP 2002-041003 A 2/2002

* cited by examiner

*Primary Examiner* — Premal Patel
(74) *Attorney, Agent, or Firm* — Maschoff Brennan

(57) ABSTRACT

A drive circuit is configured to, during a first period, sequentially select each of pairs of odd-number-th and even-number-th scanning lines and write an off electric potential into pixels corresponding the selected scanning lines; during a second period, sequentially select each of pairs of odd-number-th and even-number-th scanning lines and write gray-scale electric potentials in accordance with the selected odd-number-th scanning line into pixels corresponding to the selected odd-number-th and even-number-th scanning lines; and during a third period, sequentially select each of even-number-th scanning lines and write gray-scale electric potentials in accordance with the selected even-number-th scanning line into pixels corresponding to the selected scanning line. A common electric potential supply circuit reverses the polarity of a common electric potential during a polarity reverse period between the first period and the second period.

12 Claims, 15 Drawing Sheets

ELECTRO-OPTIC APPARATUS, DRIVING METHOD THEREFOR, AND ELECTRONICS DEVICE

BACKGROUND

1. Technical Field

The present invention relates to a technology for displaying an image.

2. Related Art

Liquid crystal display apparatuses are each provided with a plurality of scanning lines, a plurality of data lines, and a plurality of pixels each corresponding to one of intersections of the scanning lines and the data lines. In general, such a pixel includes a pixel electrode, a common electrode, a liquid crystal element interposed between the pixel electrode and the common electrode, and a transistor which is provided between the pixel electrode and one of the data lines and which is turned on/off in accordance with a scanning signal supplied from one of the scanning lines. In such a liquid crystal display apparatus, in order to prevent the occurrence of image sticking of liquid crystal, an alternate current driving method is employed. In this alternate current driving method, a common electric potential having a constant electric potential level is supplied to a common electrode, and further, the polarity of a data electric potential, which is in accordance with a gray-scale level with which display is to be performed and which is supplied to the pixel electrode, is periodically reversed relative to the common electric potential. In the case where a maximum value of the data electric potential is denoted by Vmax, and the common electric potential is denoted by Vcom, in the alternate current driving method, as shown in FIG. 17A, a selection transistor and a drive circuit which supplies the data lines with corresponding data electric potentials each require a withstand voltage denoted by 2|Vmax−Vcom|.

There is known a method in which, in order to lower a withstand voltage required for the drive circuit, the polarity of the common electric potential Vcom is reversed relative to a reference electric potential as a center of the reverse (for example, refer to JP-A-2002-41003). According to this method, as shown in FIG. 17B, a voltage denoted by |Vmax−Vcom| is sufficient for the withstand voltage of the drive circuit.

Nevertheless, in the technology disclosed in JP-A-2002-41003, the withstand voltage of the transistor results in a voltage denoted by 3|Vmax−Vcom|, as shown in FIG. 17B. It is conceived, therefore, to write an electric potential equal to the common electric potential Vcom into each of all pixels before reversing the polarity of the common electric potential Vcom.

Here, in order to maintain the cycle of the alternate current driving, first, a scanning speed is necessary to be made more than double a current scanning speed. Second, when focusing attention on pieces of data on individual lines being scanned, it is necessary to provide a vertical scanning period in order to perform the writing of an electric potential equal to the common electric potential Vcom into each of all pixels, and this leads to an addition of a period during which pieces of off data are displayed. As a result, brightness is degraded in the case of liquid crystal operating in a normally black mode, and contrast is degraded in the case of liquid crystal operating in a normally white mode. In order to mitigate influences due to these degradations, it is necessary to further shorten each vertical scanning period. Thus, it is necessary to shorten a period of time necessary to perform writing into each of pixels.

For the shortening of a period of time for writing into each of pixels, however, there have been many technical problems, such as lowering of time constant of wirings inside a panel, enhancement of a driving capability of a drive circuit, and shortening of settling time, and thus, the realization thereof has been difficult.

SUMMARY

An advantage of some aspects of the invention is to ensure a period of time necessary to perform writing into each of pixels along with lowering a withstand voltage required for each of selection transistors, and the like.

An electro-optic apparatus according to a first aspect of the invention, which displays an image for each frame period including a first period, a second period following the first period, and a third period following the second period, includes a plurality of scanning lines; a plurality of data lines; a plurality of pixels each being provided so as to correspond to one of intersections of the plurality of scanning lines and the plurality of data lines; a drive circuit configured to, in synchronization with a selection of one scanning line of the plurality of scanning lines, supply data electric potentials to respective pixels, which are included in the plurality of pixels and which correspond to the selected one scanning line, via the plurality of data lines; and a common electric potential supply circuit configured to reverse a polarity of a common electric potential supplied to a common electrode relative to a reference electric potential. Further, each of the plurality of pixels includes a pixel electrode, the common electrode which is supplied with the common electric potential, liquid crystal which is driven between the pixel electrode and the common electrode, and a transistor which electrically connects the pixel electrode and one data line of the plurality of data lines in response to the selection of one scanning line of the plurality of scanning lines. Further, the drive circuit is configured to, during the first period, sequentially select each of pairs of two mutually adjacent odd-number-th and even-number-th scanning lines among the plurality of scanning lines, and simultaneously write, as the data electric potential, an off electric potential into pixels corresponding to both the selected scanning lines; during the second period, sequentially select each of pairs of two mutually adjacent odd-number-th and even-number-th scanning lines among the plurality of scanning lines, and simultaneously write, as the data electric potentials, gray-scale electric potentials, which are in accordance with respective gray-scale levels with which pixels corresponding to one scanning line of the selected two mutually adjacent odd-number-th and even-number-th scanning lines are to be displayed, into pixels corresponding to both the selected scanning lines; and during the third period, sequentially select each of scanning lines which are among the plurality of scanning lines and which each correspond to the other one scanning line of the two mutually adjacent odd-number-th and even-number-th scanning lines, and write, as the data electric potentials, gray-scale electric potentials, which are in accordance with respective gray-scale levels with which pixels corresponding to the selected scanning line are to be displayed, into the pixels corresponding to the selected scanning line. Further, the common electric potential supply circuit reverses the polarity of the common electric potential during a period between an end of the first period and a beginning of the second period.

According to the first aspect of the invention, during the first period, the off electric potentials are written into the pixels, and subsequently, the polarity of the common electric potential is reversed. Thus, it is possible to lower a withstand voltage required for the transistor. Further, during the second period, each of pairs of two mutually adjacent odd-number-th and even-number-th scanning lines are sequentially selected, and at the same time, gray-scale electric potentials in accordance with one of the two mutually adjacent odd-number-th and even-number-th scanning lines are written into pixels corresponding to both the selected scanning lines, and during the next third period, each of scanning lines which each correspond to the other one of the above two mutually adjacent odd-number-th and even-number-th scanning lines is sequentially selected, and gray-scale electric potentials in accordance with the selected scanning line are written into pixels corresponding to the selected scanning line. Accordingly, as compared with a scanning period during which each of all the scanning lines is sequentially selected, during each of the second period and the third period, it is possible to shorten the length of a scanning period to half the length of the scanning period during which each of all the scanning lines is sequentially selected. Moreover, at the time when the second period has ended, an image having half resolution has been written, and at the time when the third period has ended, it is possible to complete writing of an image having original resolution. Thus, in the electro-optic apparatus according to the first aspect of the invention, it is possible to lower a withstand voltage required for each of the transistors, and at the same time, ensure a period of time necessary for writing into each of the pixels.

In the aforementioned electro-optic apparatus according to the first aspect of the invention, preferably, the electro-optic apparatus further includes a light source configured to irradiate the plurality of pixels with light; and a control circuit configured to perform control of luminance of the light source, and in the case where part of or a whole of a period from a beginning of the first period to an end of the second period is made a first control period, and a period other than the first control period within the frame period is made a second control period, the control circuit performs control of the light source so as to make luminance of the light irradiated to the pixels during the first control period lower as compared with that during the second control period.

During the first period, the off electric potentials are written, and during the second period, an image having half resolution is written. According to this preferable aspect, during the first control period, which includes part of or the whole of a period from the beginning of the first period to the end of the second period and which allows writing of an incomplete image, the luminance of light irradiated to pixels is made lower, and thus, it is possible to enhance the quality of a displayed image. Here, it is preferable to adjust the luminance of the light source during the second control period T2 so as to compensate the amount of light having been reduced during the first control period T1. In addition, the light source may be one having an electric-discharge lamp and a movable aperture. In this case, the luminance of light irradiated to pixels may be adjusted by using this aperture.

Further, in the aforementioned electro-optic apparatus, preferably, the frame period further includes a fourth period, and during the fourth period, the drive circuit sequentially selects each of the plurality of scanning lines, and writes, as the data electric potentials, gray-scale electric potentials, which are in accordance with respective gray-scale levels with which pixels corresponding to the selected scanning line are displayed, into the pixels corresponding to the selected scanning line. According to this preferable aspect of the invention, even when a voltage applied to the liquid crystal varies because of a leak electric current of the transistor, it is possible to enhance the quality of a displayed image because, during the fourth period, each of all the scanning lines is scanned and corresponding gray-scale electric potentials are written.

Further, in the aforementioned electro-optic apparatus, preferably, the electro-optic apparatus further includes a light source configured to irradiate the plurality of pixels with light; and a control circuit configured to perform control of luminance of the light source, and in the case where part of or a whole of a period from a beginning of the first period to an end of the third period is made a first control period, and a period other than the first control period within the frame period is made a second control period, the control circuit performs control of the light source so as to make luminance of the light irradiated to the pixels during the first control period lower as compared with that during the second control period.

During the first period, the off electric potentials are written, during the second period, an image having half resolution is written, and during the third period, gray-scale electric potentials are written into pixels each corresponding to the other one of the odd-number-th and even-number-th scanning lines. Accordingly, it is possible to complete writing of an image having original resolution at the time when the third period has ended. According to this preferable aspect, during the first control period, which includes part of or the whole of a period from the beginning of the first period to the end of the third period and which is a period before the completion of writing of a complete image, the luminance of the light source is made lower, and thus, it is possible to enhance the quality of a displayed image. Here, preferably, the control circuit is configured to perform control of the luminance of the light source during the second control period T2 so as to compensate the amount of light having been reduced during the first control period T1.

In the aforementioned electro-optic apparatus, preferably, the control circuit is capable of performing switching between a normal mode in which the luminance of the light source is kept to constant luminance, and a light control mode in which the luminance of the light source is adjusted so as to be different between the first control period and the second control period. According to this preferable aspect, it is made possible to perform switching of modes which determine whether an adjustment of the luminance of the light source is to be carried out, or not. Here, the control circuit may perform switching between the normal mode and the light controlling mode on the basis of a user's input command, or may automatically perform switching between the normal mode and the light controlling mode.

In the aforementioned electro-optic apparatus, preferably, the frame period further includes a fourth period and a fifth period; a right-eye image and a left-eye image, which are stereoscopic through a pair of stereoscopic spectacles including a right-eye shutter and a left-eye shutter, are displayed; a spectacles control circuit for controlling the left-eye shutter and the right-eye shutter is provided. Further, preferably, the drive circuit is configured to, during the fourth period, sequentially select each of pairs of two mutually adjacent odd-number-th and even-number-th scanning lines among the plurality of scanning lines, and simultaneously write, as the data electric potentials, gray-scale electric potentials, which are in accordance with respective gray-scale levels with which pixels corresponding to one scanning line of the selected two mutually adjacent odd-number-th and even-number-th scanning lines are to be displayed, into pixels corresponding to both the selected scanning lines; and during the fifth period, sequentially select each of scanning lines which are among the plurality of scanning lines and which each correspond to the other one scanning line of the two mutually adjacent odd-number-th and even-number-th scanning lines, and write, as the data electric potentials, gray-scale electric potentials, which are in accordance with respective gray-scale levels with which pixels corresponding to the selected scanning line are to be displayed, into the pixels corresponding to the selected scanning line. Further, preferably, the gray-scale electric potentials written into the pixels during each of the second period and the third period are gray-scale electric potentials for one of the right-eye image and the left-eye image, and the gray-scale electric potentials written into the pixels during each of the fourth period and the fifth period are gray-scale electric potentials for the other one of the right-eye image and the left-eye image; and the spectacles control circuit causes one shutter of the right-eye shutter and the left-eye shutter to transit from a closed state to an open state at the beginning of the fifth period of a certain frame period, and transit from the open state to the closed state at the beginning of the fourth period of a next frame period, and causes the other one shutter of the right-eye shutter and the left-eye shutter to transit from an open state to a closed state at the beginning of the fourth period of the certain frame period, and transit from the closed state to the open state at the beginning of the fifth period of the next frame period.

According to this preferable aspect, during the first period, the off electric potentials are written into the respective pixels, and subsequently, the polarity of the common electric potential is reversed. Thus, it is possible to lower a withstand voltage required for the transistor. Further, one of the right-eye image and the left-eye image is written during the second period and the third period, and the other one of the right-eye image and the left-eye image is written during the fourth period and the fifth period. Thus, it is possible to display a stereoscopic image. Further, even when the right-eye image and the left-eye image GL are different from each other, a direct current element of a voltage applied to the liquid crystal can be made zero.

Next, an electronics device according to a second aspect of the invention includes the aforementioned electro-optic apparatus. Electronics devices pertinent to such an electronic device include a personal computer, a mobile telephone, a stereoscopic display apparatus and the like.

Next, a driving method according to a third aspect of the invention is for use in an electro-optic apparatus that displays an image for each frame period including a first period, a second period following the first period, and a third period following the second period, and that includes a plurality of scanning lines, a plurality of data lines, and a plurality of pixels each being provided so as to correspond to one of intersections of the plurality of scanning lines and the plurality of data lines, and including a pixel electrode, a common electrode which is supplied with a common electric potential, liquid crystal which is driven between the pixel electrode and the common electrode, and a transistor which electrically connects the pixel electrode and one data line of the plurality of data lines in response to a selection of one scanning line of the plurality of scanning lines. Further, the driving method includes, during the first period, sequentially selecting each of pairs of two mutually adjacent odd-number-th and even-number-th scanning lines among the plurality of scanning lines, and simultaneously writing, as a data electric potential, an off electric potential into pixels corresponding to both the selected scanning lines; during a period between an end of the first period and a beginning of the second period, reversing a polarity of the common electric potential; during the second period, sequentially selecting each of pairs of two mutually adjacent odd-number-th and even-number-th scanning lines among the plurality of scanning lines, and simultaneously writing, as data electric potentials, gray-scale electric potentials, which are in accordance with respective gray-scale levels with which pixels corresponding to one scanning line of the selected two mutually adjacent odd-number-th and even-number-th scanning lines are to be displayed, into pixels corresponding to both the selected scanning lines; and during the third period, sequentially selecting each of scanning lines which are among the plurality of scanning lines and which each correspond to the other one scanning line of the two mutually adjacent odd-number-th and even-number-th scanning lines, and writing, as data electric potentials, gray-scale electric potentials, which are in accordance with respective gray-scale levels with which pixels corresponding to the selected scanning line are to be displayed, into the pixels corresponding to the selected scanning line. According to this third aspect of the invention, it is possible to lower a withstand voltage required for each of the transistors, and at the same time, ensure a period of time necessary for writing into each of the pixels.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Embodiment

Figure 1:
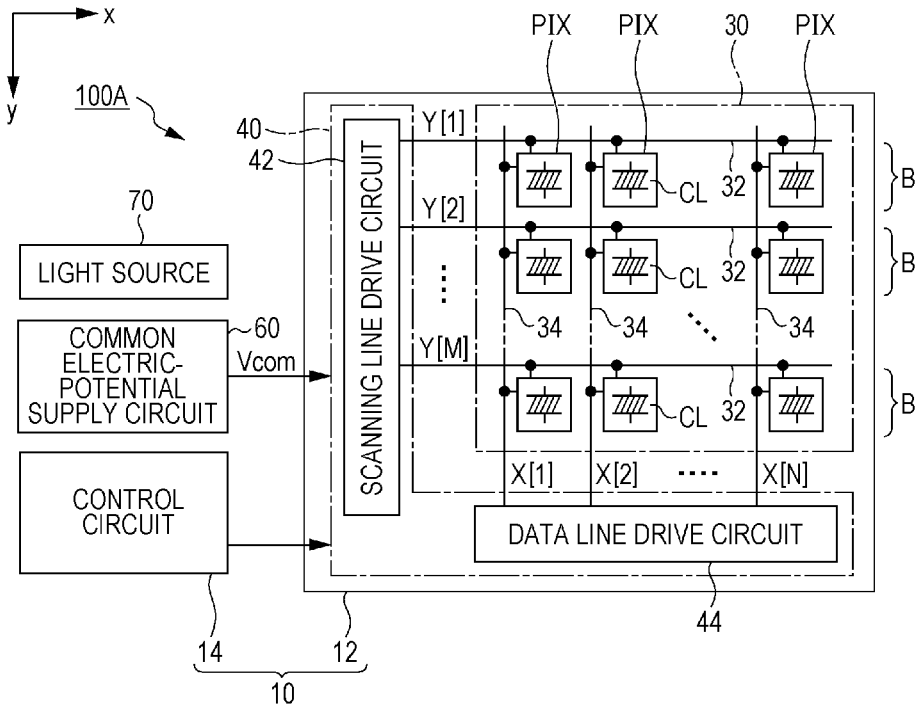
FIG. 1 is a block diagram of an electro-optic apparatus according to a first embodiment of the invention.

FIG. 1 is a block diagram illustrating an electro-optic apparatus 100 according to a first embodiment of the invention. The electro-optic apparatus 100 includes a common electric-potential supply circuit 60 for supplying a common electrode with a common electric potential Vcom, and a light source 70 functioning as a backlight of a liquid crystal display apparatus 10. The liquid crystal display apparatus 10 includes an electric-optical panel 12 and a control circuit 14. The electro-optic panel 12 includes a pixel portion 30 in which a plurality of pixels (pixel circuits) PIX is arranged, and a drive circuit 40 for driving the individual pixels PIX. In the pixel portion 30, M numbers of scanning lines 32 extending in an x-direction, and N numbers of data lines 34 extending in a y-direction and intersecting with the scanning lines 32 extending in the x-direction are formed (M and N are each a natural number). The plurality of pixels PIX included in the pixel portion 30 are arranged in a matrix shape of vertical M rows×horizontal N columns so as to correspond to respective intersections of the scanning lines 32 and the data lines 34.

Figure 2:
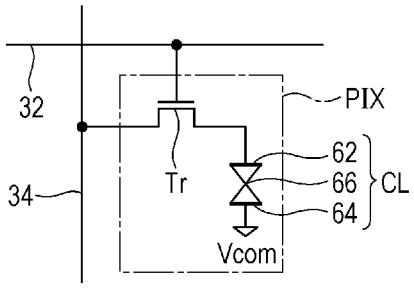
FIG. 2 is a circuit diagram of a pixel circuit according to a first embodiment of the invention.

FIG. 2 is a circuit diagram of each of the pixels PIX. As shown in FIG. 2, each pixel includes a liquid crystal element CL and a transistor Tr. This liquid crystal element CL is an electro-optic element composed of a pixel electrode 62 (a first electrode) and a common electrode 64 (a second electrode) which are opposite to each other, and liquid crystal 66 interposed between these both electrodes. A transmittance (displayed gray scale) of the liquid crystal 66 varies in accordance with the level of an applied voltage between the pixel electrode 62 and the common electrode 64. The transistor Tr is composed of an N-channel type thin-film transistor whose gate electrode is connected to one of the scanning lines 32, and exists between the liquid crystal element CL and one of the data lines 34 to control an electric connection operation (i.e., a conduction operation and an insulation operation) therebetween. In the case where m is made any one of natural numbers from 1 to M, and n is made any one of natural numbers from 1 to N, setting a scanning line Y [m] to a selection electric-potential level causes each of transistors Tr included in respective pixels PIX corresponding to an m-th row to transit to an on-state. The pixel PIX (the liquid crustal element CL) corresponding to the relevant transistor Tr is displayed with a gray-scale level corresponding to a data electric-potential X [n] on a corresponding one of the data lines 34 at the time when the relevant transistor Tr has been controlled to transit to the on-state (that is, at the time when the relevant scanning line 32 has been selected). In addition, it is also possible to employ a configuration in which an auxiliary capacitor is connected in parallel with the liquid crystal element CL.

The drive circuit 40 shown in FIG. 1 includes a scanning line drive circuit 42 and a data line drive circuit 44. The drive circuit 40 operates by being supplied with a power source voltage from a power supply circuit 50. The scanning line drive circuit 42 sequentially selects each of the scanning lines 32 by supplying the relevant scanning line 32 with one of scanning signals Y [1] to Y [M] which corresponds to the relevant scanning line 32. When a scanning signal Y [m] (m is any one of natural numbers from 1 to M) is set to a predetermined selection electric-potential level, an m-th row of the scanning lines 32 is selected. In synchronization with the selection of the m-th row of the scanning lines 32, made by the scanning line drive circuit 42, the data line drive circuit 44 supplies the N number of data lines 34 with respective data electric potentials X [1] to X [N].

Figure 3:
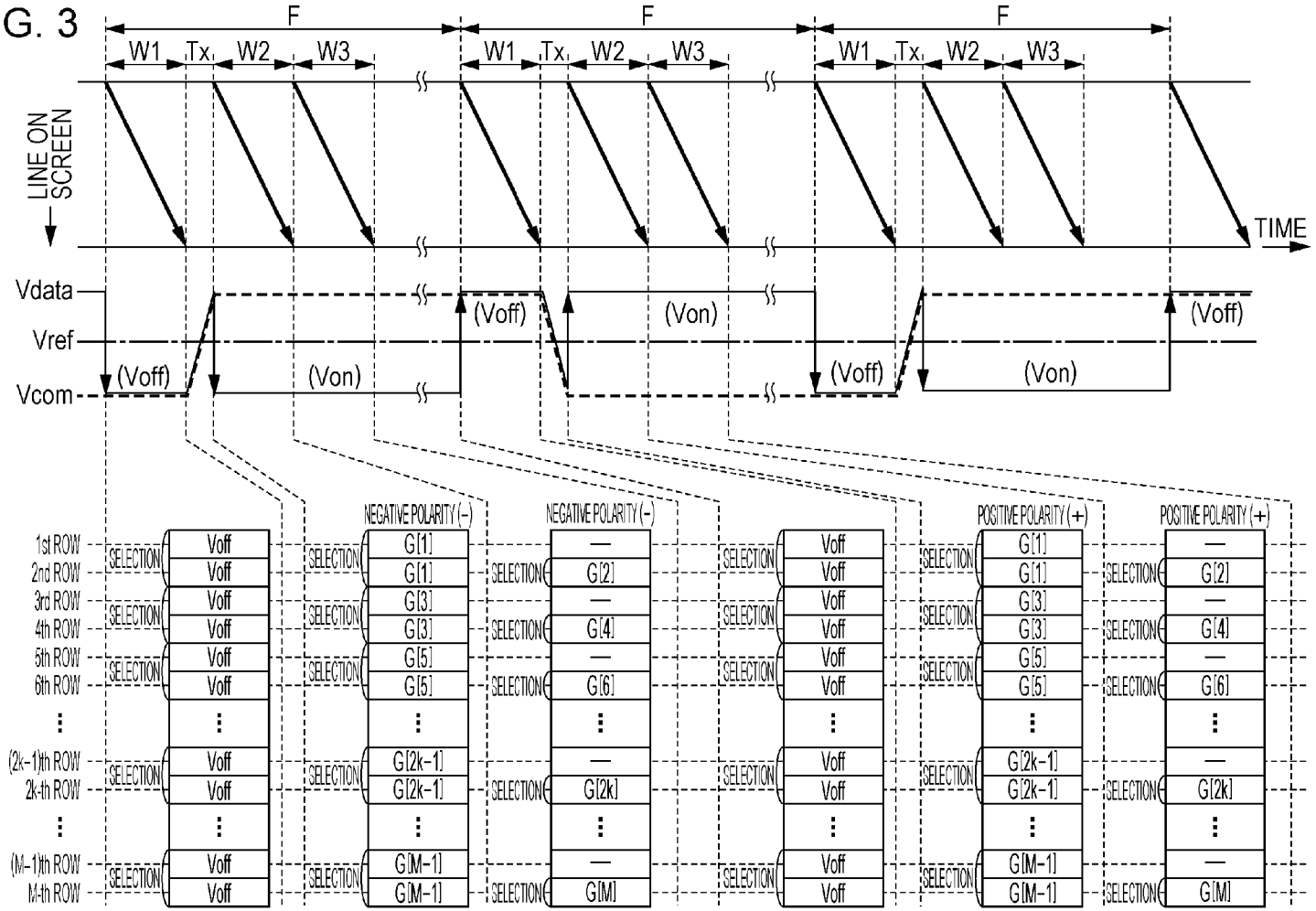
FIG. 3 is a diagram for describing operation of a liquid crystal display apparatus according to a first embodiment of the invention.

FIG. 3 is a diagram for describing operation of the liquid crystal display apparatus 10. The liquid crystal display apparatus 10 is controlled on a frame period by frame period basis, and the frame period includes a first period W1, a second period W2, a third period W3, and a polarity reverse period T which is provided between the first period W1 and the second period W2. As shown in FIG. 3, during the polarity reverse period Tx, the polarity of the common electric-potential Vcom is reversed relative to a reference electric potential Vref. In addition, a data electric potential X [n], which corresponds to white in the case of liquid crystal operating in a normally black mode, and corresponds to black in the case of liquid crystal operating in a normally white mode, is made an on electric potential Von; while a data electric potential X [n], which corresponds to black in the case of liquid crystal operating in a normally black mode, and corresponds to white in the case of liquid crystal operating in a normally white mode, is made an off electric potential Voff. Here, when display is performed with gray-scale corresponding to the on electric potential Von, an electric potential Vdata written into the electrode pixel 62 is such as shown in FIG. 3.

Figure 4:
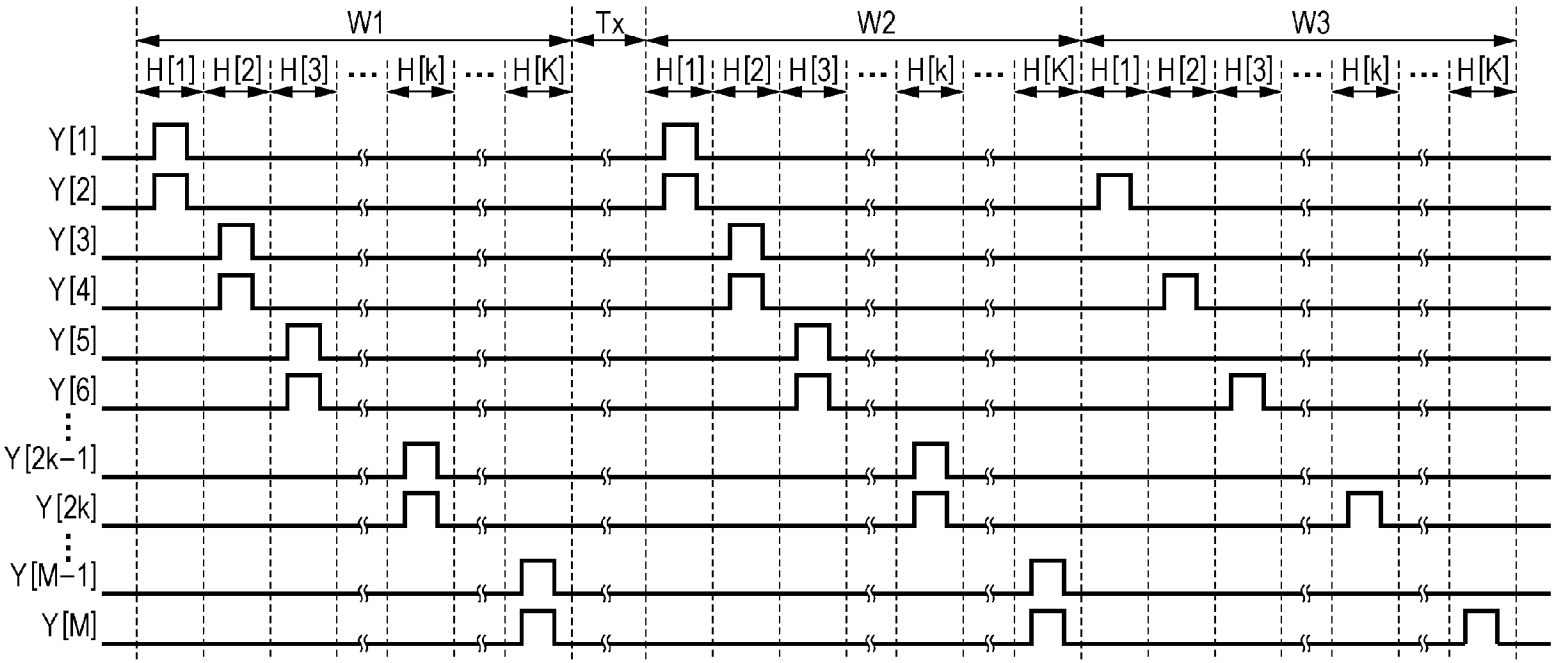
FIG. 4 is a diagram for describing operation of a scanning line drive circuit according to a first embodiment of the invention.

Operation of the scanning line drive circuit 42 is shown in FIG. 4. In each of the first period W1 and the second period W2 within each frame period F, the scanning line drive circuit 42 sequentially selects each of pairs of two mutually adjacent scanning lines 32 as a selection unit during a corresponding one of selection periods H [1] to H [k]. That is, during a k-th selection period H [k] (k is any one of natural numbers from 1 to K) of the first period W1, an odd-number-th row scanning signal Y [2k−1] and an even-number-th row scanning signal Y [2k] are simultaneously set to a selection electric-potential level, and thereby, a (2k−1)th row of the scanning lines 32 (an odd-number-th row of pixel circuit groups B) and a 2k-th row of the scanning lines 32 (an even-number-th row of the pixel circuit groups B) are simultaneously selected. For example, during a selection period H [1], a 1st row of the scanning lines 32 and a 2nd row of the scanning lines 32 are simultaneously selected, and during a selection period H [2], a 3rd row of the scanning lines 32 and a 4th row of the scanning lines 32 are simultaneously selected. Accordingly, a total number K of the selection periods H [k] within the first period W1 corresponds to half the total number M of the scanning lines 32 (the number of rows of the pixel circuit groups B) (i.e., K=M/2). In addition, in this example, it is supposed a case where the total number M of the scanning lines 32 is an even number, but the total number M of the scanning lines 32 may be an odd number. In this case, a final row of the scanning lines 32 becomes an odd-number-th row, and is selected by the scanning line drive circuit 42 as an odd-number-th row. Further, a writing operation based on data electric potentials provided, via the data lines 34, by the data line drive circuit 44 is performed.

Meanwhile, in the third period W3 of each frame period F, the scanning line drive circuit 42 sequentially selects each of even-number-th rows of the scanning lines 32 during a corresponding one of the selection periods H [1] to H [k]. That is, during a k-th selection period H [k] of the third period W3, a scanning signal Y [2k] is set to a selection electric-potential level, and thereby, just one line of the scanning lines 32, that is, a 2k-th row of the scanning lines 32 (a 2k-th row of the pixel circuit groups B) is selected. For example, during a selection period H [1], a 2nd row of the scanning lines 32 is selected, and during a selection period H [2], a 4th row of the scanning lines 32 is selected. Accordingly, in the third period W3, K numbers (M/2 numbers) of selection periods H [1] to H [K] are included, just like in the case of the first period W1.

As shown in FIG. 3, during the first period W1, the data line drive circuit 44 supplies the off electric potentials Voff, as the respective data electric potentials X [1] to X [N], to each of the data lines 34. As a result of this operation, a voltage applied to each of the liquid crystal element CL becomes 0 V, and thereby, there does not occur any situation where an excessive voltage is applied between a drain electrode and a source electrode of the corresponding transistor Tr even when the polarity of the common electric potential Vcom is reversed during the polarity reverse period Tx. Further, so that the polarity of a voltage applied to each of the liquid crystal elements CL of the pixel circuits PIX after the polarity inversion period Tx becomes reverse to that before the polarity reverse period Tx, the polarity of each of the data electric potentials X [n] is reversed. Specifically, each of the data electric potentials X [n] is set to a negative polarity (−) side relative to the common electric potential Vcom during each of odd-number-th frame periods F, and each of the data electric potentials X [n] is set to a positive polarity (+) side relative to the common electric potential Vcom during each of even-number-th frame periods F.

During a selection period H [k] of the second period W2 when a (2k−1)th row of the scanning lines 32 and a 2k-th row of the scanning lines 32 are simultaneously selected, the data line drive circuit 44 supplies the data lines 34 with respective data electric potentials X [n] in accordance with specified gray-scale levels G [2k−1] for respective pixels corresponding to the (2k−1)th row of the scanning lines 32. As a result of this operation, in the second period W2, gray-scale electric potentials, with which pixels corresponding to the selected odd-number-th scanning line 32 are to be displayed, are simultaneously written, as data electric potentials x [n], into pixels corresponding to both the simultaneously selected scanning lines.

For example, during a selection period H [1], data electric potentials X [n] in accordance with specified gray-scale levels G [1] for respective pixels corresponding to a 1st row is supplied to pixel circuits PIX corresponding to the 1st row and a 2nd row, and during a selection period H [2], data electric potentials X [n] in accordance with specified gray-scale levels G [3] for respective pixels corresponding to a 3rd row is supplied to pixel circuits PIX corresponding to the 3rd row and a 4th row. As described above, since any two mutually adjacent odd-number-th and even-number-th pixel circuits PIX in the y-direction are supplied with respective mutually equal data electric potentials X [n], an image whose resolution in the y-direction is reduced to half the original resolution is displayed on the pixel portion 30 at the time when the second period W2 ends.

Meanwhile, during a selection period H [k] of the third period W3 when a 2k-th row of the scanning lines 32 is selected, the data line drive circuit 44 supplies the data lines 34 with respective data electric potentials X [n] in accordance with specified gray-scale levels G [2k] for respective pixels corresponding to the selected 2k-th row of the scanning lines 32. Specifically, during a selection period H [1], data electric potentials X [n], which are in accordance with specified gray-scale levels G [2] for respective pixels corresponding to a 2nd row, are supplied to pixel circuits PIX corresponding to the 2nd row, and during a selection period H [2], data electric potentials X [n], which are in accordance with specified gray-scale levels G [4] for respective pixels corresponding to a 4th row, are supplied to pixel circuits PIX corresponding to the 4th row. Meanwhile, voltages applied to the liquid crystal elements CL of the respective pixel circuits PIX corresponding to each of odd-number-th lines are kept to voltages having been applied during the immediately previous second period W2. Accordingly, the image having been displayed with half resolution in the y-direction at the end of the second period W2 is updated into an image having the originally desired resolution (M rows×N columns) at the end of the third period W3.

As described above, in this embodiment, it is possible to, without any shortening of a period of time necessary to perform writing into each of the pixels, ensure the brightness or the contrast of a displayed image, and at the same time, lower a withstand voltage required for the transistor Tr. As a result, it is possible to reduce the size of the transistor, and display images with high resolution.

2. Second Embodiment

Figure 5:
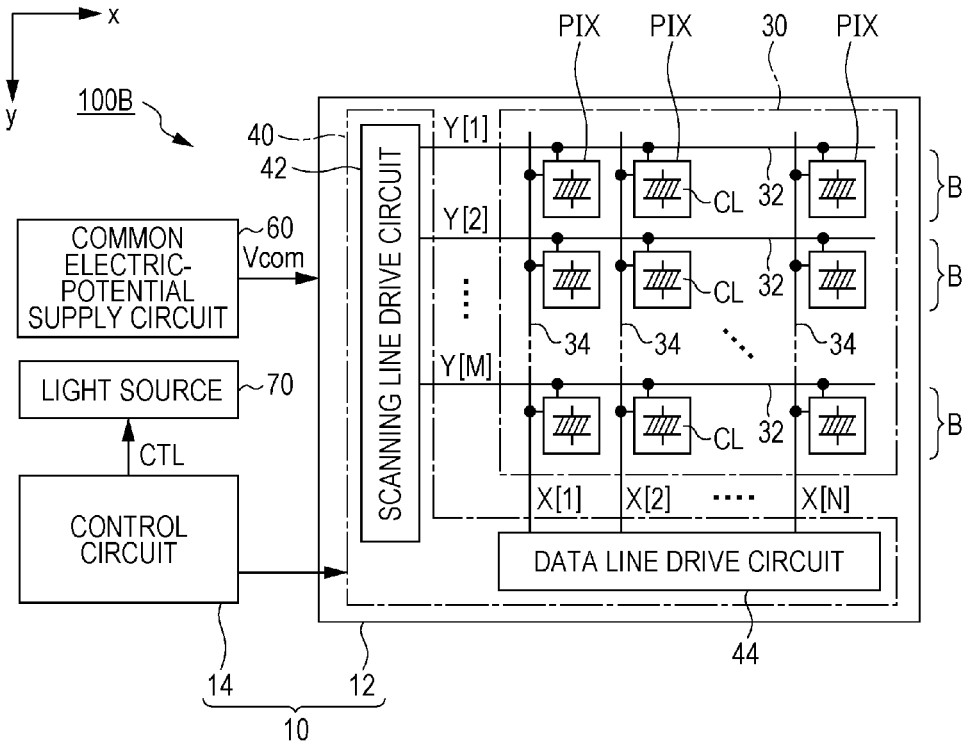
FIG. 5 is a block diagram of an electro-optic apparatus according to a second embodiment of the invention.

FIG. 5 is a block diagram of an electro-optic apparatus 100B according to a second embodiment of the invention. The electro-optic apparatus 100B is configured just like the electro-optic apparatus 100A of the first embodiment, except that the luminance of the light source 70 is controlled by the control circuit 14.

The luminance of the light source 70 is controlled on the basis of a control signal CTL supplied from the control circuit 14. Specifically, the light source 70 is controlled so as to make the luminance thereof during a period when the control signal CTL is in a low level lower as compared with the luminance thereof during a period when the control signal CTL is in a high level.

Figure 6:
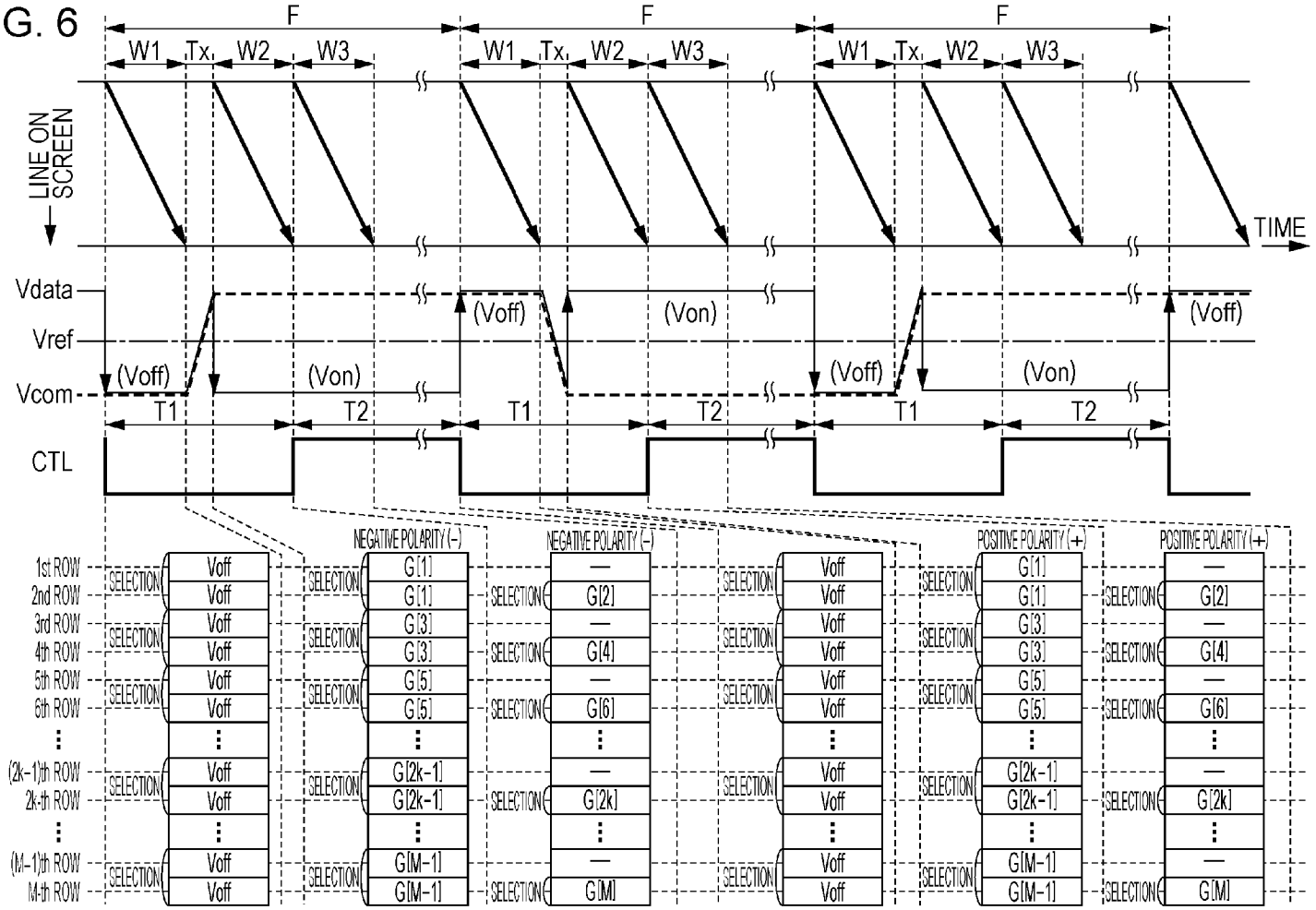
FIG. 6 is a diagram for describing operation of a liquid crystal display apparatus according to a second embodiment of the invention.

FIG. 6 is a diagram for describing operation of the liquid crystal display apparatus 10. In the case where a period from the beginning of the first period W1 to the end of the second period W2 is made a first control period T1, and a period other than the first control period T1 within the frame period F is made a second control period T2, the control signal CTL is in a low level during the first control period T1; while the control signal CTL is in a high level during the second control period T2. That is, the control circuit 40 performs control so as to make the luminance of the light source 70 during the first control period T1 lower as compared with that during the second control period T2.

The first control period T1 of this example includes the first period W1 during which the off electric potentials Voff are written, the polarity reverse period Tx, and the second period W2 during which an image having low resolution is written. Meanwhile, the second control period T2 includes the third period W3 during which an image having high resolution is formed. Accordingly, when comparing the first control period T1 and the second control period T2, the second control period T2 enables display of an image having a higher quality than the first control period T1.

Meanwhile, in general, the rating of a light source is defined as a logical product of an average power-consumption maximum rating and a momentary power-consumption maximum rating. Thus, in return for turning off the light source 70 or reducing the luminance of the light source 70 during the first control period T1, during the second control period T2, the luminance of the light source 70 is made higher by inputting a larger amount of electric power to the light source 70.

According to the electric-optic apparatus 100B of the second embodiment, the above-described configuration enables enhancement of the brightness or the contrast of a displayed image, as compared with the electric-optic apparatus 100A of the first embodiment.

3. Third Embodiment

A third embodiment is configured just like the first embodiment except that a fourth period W4 is provided, and during the fourth period W4, each of the scanning lines 32 is sequentially selected to write the data electric potentials X [n] corresponding to the selected scanning line 32, that is, to write the data electric potentials X [n] for each row of the scanning lines 32.

Figure 7:
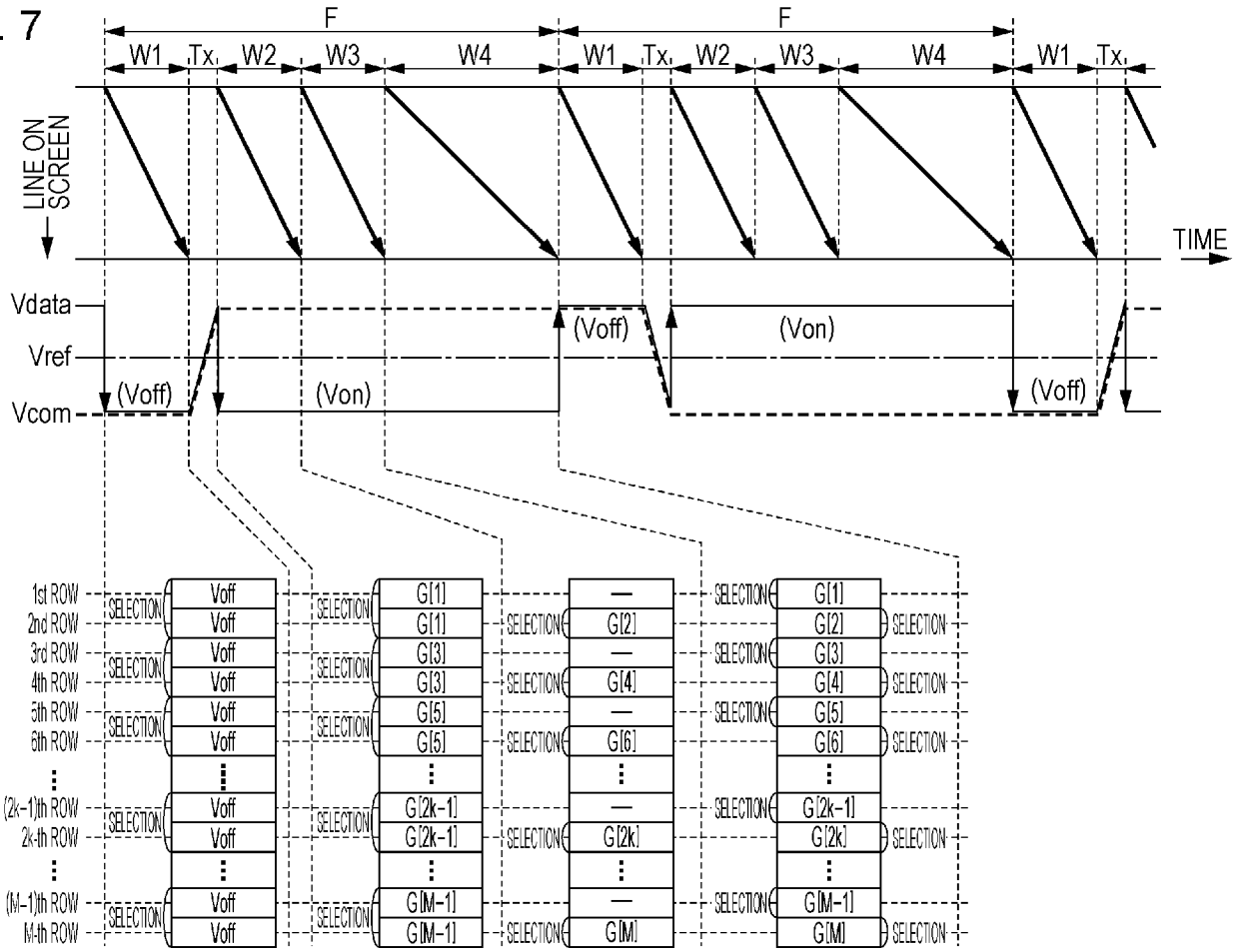
FIG. 7 is a diagram for describing operation of a liquid crystal display apparatus according to a third embodiment of the invention.

FIG. 7 is a diagram for describing operation of the liquid crystal display apparatus 10. The period F includes a fourth period W4 besides the first period W1 during which, sequentially, two mutually adjacent rows of the scanning lines 32 are simultaneously selected, and the off electric potentials are written into pixels corresponding to both the selected two rows; the polarity reverse period Tx; the second period W2 during which, sequentially, two mutually adjacent odd-number-th row and even-number-th row of the scanning lines 32 are simultaneously selected, and gray-scale electric potentials for respective pixels corresponding to the selected odd-number-th row are simultaneously written into pixels corresponding to both the selected odd-number-th row and the even-number-th row; and the third period W3 during which, sequentially, an even-number-th row of the scanning lines 32 is selected, and gray-scale electric potentials for respective pixels corresponding to the selected even-number-th row are written into the pixels corresponding to the selected even-number-th row.

Figure 8:
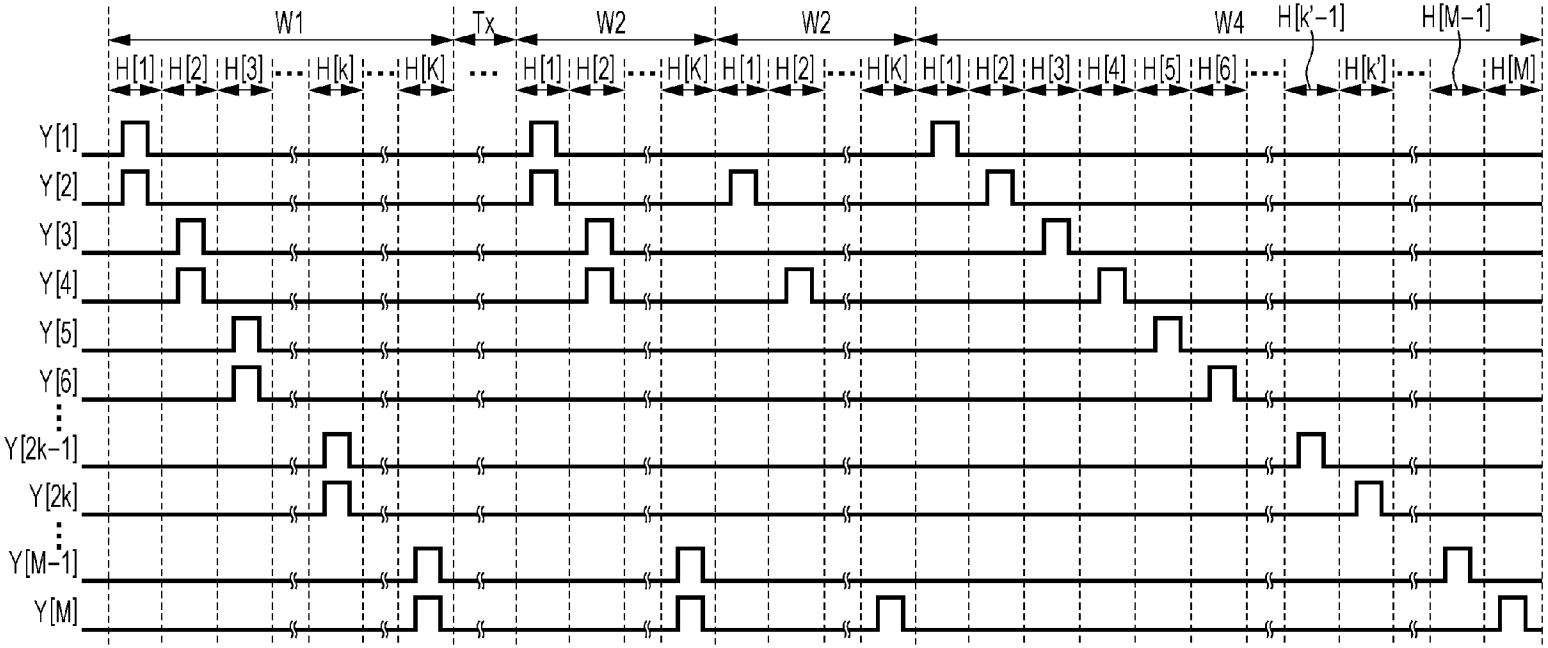
FIG. 8 is a diagram for describing operation of a scanning line drive circuit according to a third embodiment of the invention.

In FIG. 8, operation of the scanning line drive circuit 42 is illustrated. Operations of the first to third periods W1 to W3 of each frame period F are the same those having been described with reference to FIG. 4 in the first embodiment. In the fourth period W4 of each frame period F, the scanning drive circuit 42 sequentially selects each of the scanning lines 32 as a selection unit during a corresponding one of selection periods H [1] to H [M]. That is, during a k'-th selection period H [k'] (k' is any one of natural numbers from 1 to M) of the fourth periods W4, a scanning signal Y [2k] is set to a selection electric-potential level, and thereby a 2k-th row of the scanning lines 32 is selected. For example, during a selection period H[1], a 1st row of the scanning lines 32 is selected, and during a selection period H[2], a 2nd row of the scanning lines 32 is selected. Accordingly, the total number M of the selection periods H [k'] within the fourth period W4 corresponds to the total number M of the scanning lines 32.

As shown in FIG. 7, during a selection period H [k'], in which a 2k-th row of the data lines 32 is selected, within the fourth period W4, the data line drive circuit 44 supplies the data lines 34 with respective data electric potentials X [n], which are in accordance with specified gray-scale levels G [2k] for respective pixels corresponding to the 2k-th row of the scanning lines 32. As a result, during the fourth period W4, the data electric potentials X [n] are written for each of the rows.

For example, during a selection period H [1], data electric potentials X [n], which are in accordance with specified gray-scale levels G [1] for respective pixels corresponding to a first row, are supplied to respective pixel circuits PIX corresponding to the first row, and during a selection period H [2], data electric potentials X [n], which are in accordance with specified gray-scale levels G [2] for respective pixels corresponding to a second row, are supplied to respective pixel circuits PIX corresponding to the second row. As described below, since the data electric potentials X [n] are supplied for each of the rows, an image having resolution corresponding to the total number M of the scanning lines 32 is displayed on the pixel portion 30 at the time when the fourth period W4 has ended.

The electric potential X [n] is written into a corresponding one of the liquid crystal elements CL, and the liquid crystal element retains the written voltage, but the retained voltage is lowered because of a leak electric current of the transistor Tr. According to this embodiment, since the fourth period W4 is provided, a retention period of each of liquid crystal elements CL corresponding to even-number-th rows, as well as a retention period of each of liquid crystal elements CL corresponding to odd-number-th rows, is shortened. Further, in the first embodiment, a retention period of each of liquid crystal elements CL corresponding to odd-number-th rows is longer than a retention period of each of liquid crystal elements CL corresponding to even-number-th rows, but, according to this embodiment, it is possible to shorten the difference in the retention period of each of liquid crystal elements CL between the odd-number-th rows and the even-number-th rows. It is possible, therefore to suppress the unevenness of display, which occurs depending on which of odd-number-th rows and even-number-th rows individual pixels forming a displayed image belong to.

4. Fourth Embodiment

An electro-optic apparatus according to a fourth embodiment is configured just like the above-described electro-optic apparatus 100B (refer to FIG. 5) of the second embodiment. In addition, the electro-optic apparatus according to the fourth embodiment is different from the electro-optic apparatus 100B of the second embodiment in the respect that the fourth period W4 is provided just like in the case of the third embodiment.

Figure 9:
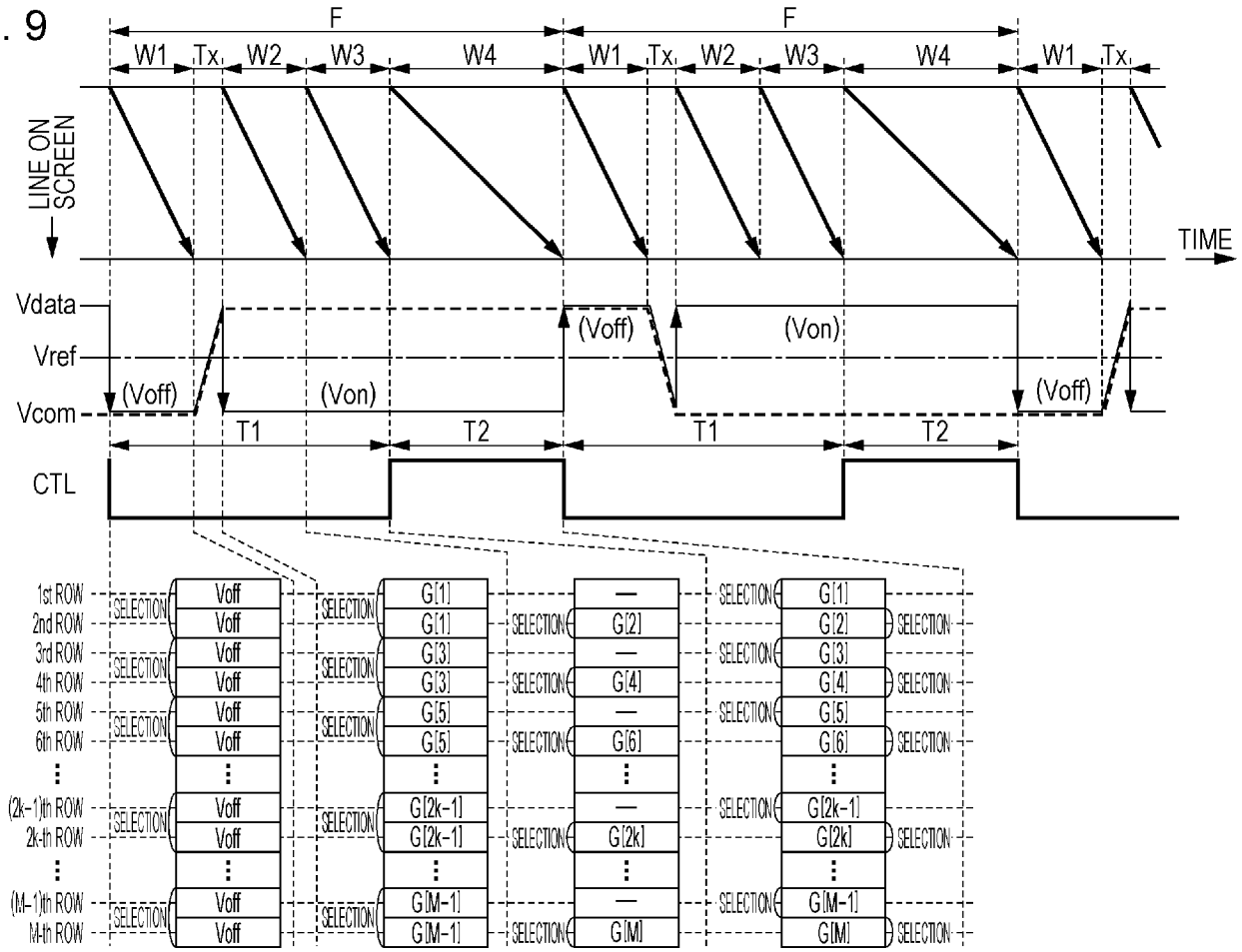
FIG. 9 is a diagram for describing operation of a liquid crystal display apparatus according to a fourth embodiment of the invention.

FIG. 9 is a diagram for describing operation of the liquid crystal display apparatus 10. In this fourth embodiment, a period from the beginning of the first period W1 to the end of the third period W3 is made a first control period T1, and a period other than the first control period T1 within the frame period F is made a second control period T2. The control circuit 14 generates a control signal CTL which is in a low level during the first control period T1 and is in a high level during the second control period T2, and performs control so as to make the luminance of the light source 70 during the first control period T1 lower as compared with that during the second control period.

The first control period T1 of this example includes the first period W1, the polarity reverse period Tx, the second period W2, and the third period W3. Meanwhile, the second control period T2 includes the fourth period W4 during which an image having high resolution is formed for each of rows. In the middle of the third period W3, an image having high resolution is being formed, and at the time when the third period W3 has ended, data electric potentials X [n], which are in accordance with respective gray-scale levels with which corresponding pixels are to be originally displayed, have been written into pixels corresponding to each of the rows.

Accordingly, according to this fourth embodiment, since, in return for turning off the light source 70 or lowering the luminance of the light source 70 during the first control period T1, during the second control period T2, the luminance of the light source 70 is made higher by inputting a larger amount of electric power to the light source 70, there is an advantage in that, without degrading the brightness or the contrast not so much as compared with those in the case of the third embodiment, it is possible to obtain resolution of a completely original image.

5. Fifth Embodiment

Figure 10:
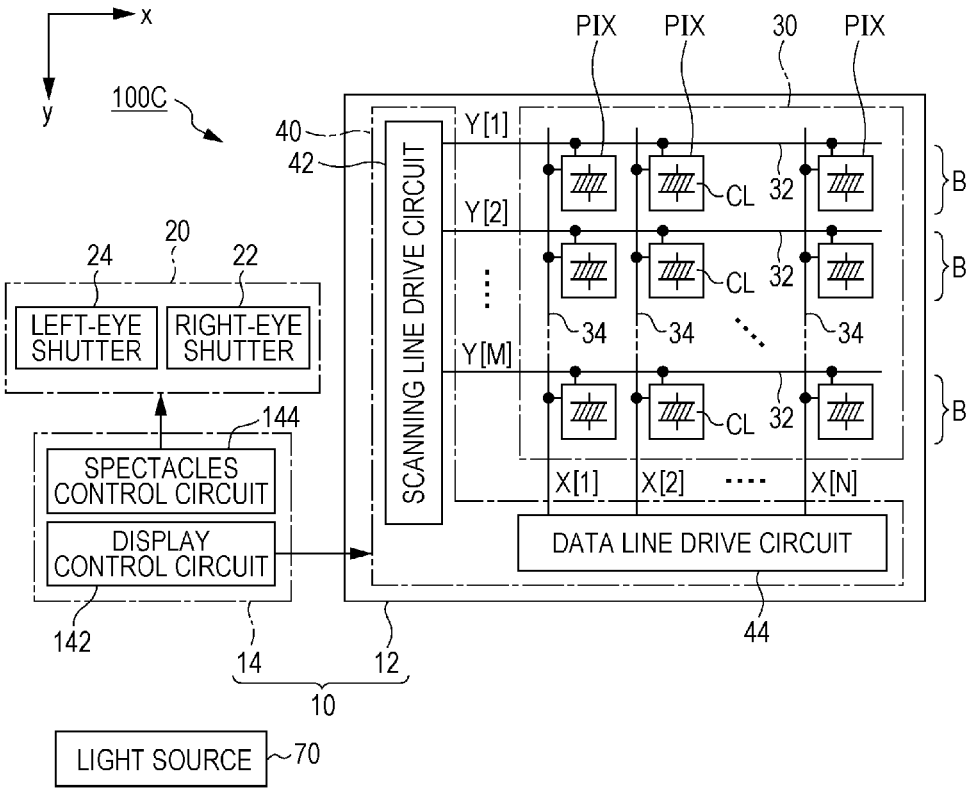
FIG. 10 is a block diagram of an electro-optic apparatus according to a fifth embodiment of the invention.

FIG. 10 is a block diagram illustrating an electro-optic apparatus 100C according to a fifth embodiment of the invention. The electro-optic apparatus 100C is an electronics device which displays stereoscopic images which allow an observer to perceive a stereoscopic feeling by using an active shutter method, and includes a liquid crystal display apparatus 10, a pair of stereoscopic spectacles 20 and a light source 70. The electro-optic apparatus 10 alternately displays a right-eye image GR and a left-eye image GL on a time division basis, and is configured just like the liquid crystal display apparatus 10 having been described with reference to FIGS. 1 and 2 in the first embodiment. In addition, a detailed configuration of the control circuit 14 is different from that of the first embodiment.

The pair of stereoscopic spectacles 20 is a spectacles-type instrument an observer wears when viewing stereoscopic images displayed by the electro-optic apparatus 10, and includes a right-eye shutter 22 which is located at the front of a right eye of the observer, and a left-eye shutter 24 which is located at the front of a left eye of the observer. The right-eye shutter 22 and the left-eye shutter 24 are each controlled so as to have an open state (a light transmitting state) in which irradiated light is transmitted, and a closed state (a light shielding state) in which irradiated light is shielded. For example, a liquid crystal shutter, which changes from one to the other one of the open state and the closed state by changing an alignment direction of liquid crystal in response to a change of an applied voltage, can be employed as each of the right-eye shutter 22 and the left-eye shutter 24.

The control circuit 14 includes a display control circuit 142 for controlling an electro-optic panel 142, and a spectacles control circuit 144 for controlling the pair of stereoscopic spectacles 20. In addition, a configuration, in which both of the display control circuit 142 and the spectacles control circuit 144 are mounted into a single integrated circuit, can be employed, or another configuration, in which the display control circuit 142 and the spectacles control circuit 144 are separated into respective different body integrated circuits, can be employed. The display control circuit 142 performs control of the drive control circuit 40 so that the right-eye image GR and the left-eye GL which are given mutually different viewing angles can be displayed on the pixel portion 30 on a time division basis. Specifically, the display control circuit 142 performs control so as to cause the drive circuit 40 to carry out the following operation.

Figure 11:
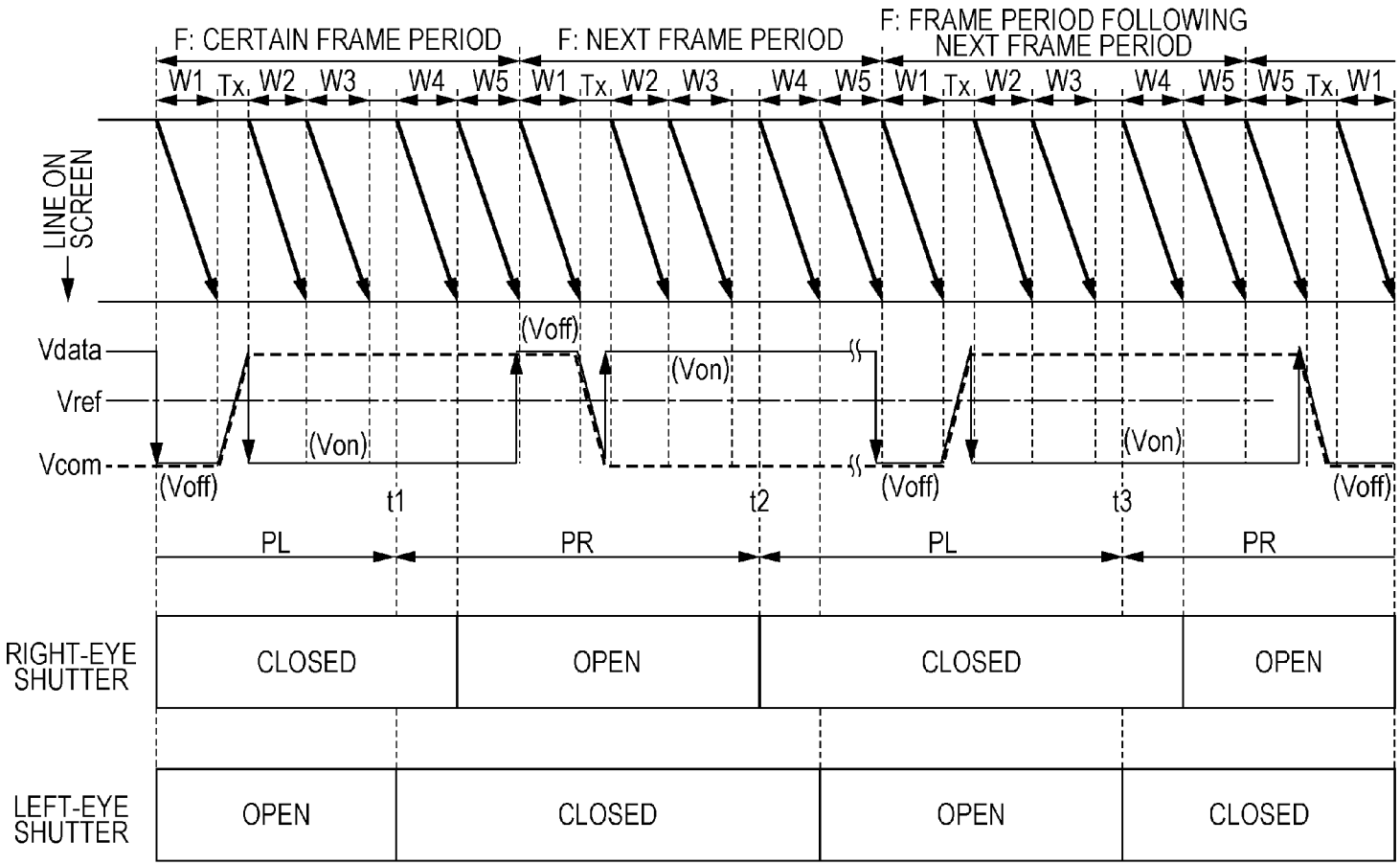
FIG. 11 is a diagram for describing operation of a liquid crystal display apparatus according to a fifth embodiment of the invention.

FIG. 11 is a diagram for describing operation of the electro-optic apparatus 10. An operation period of the electro-optic apparatus 10 is sectioned into a right-eye period PR during which the right-eye image GR is displayed and a left-eye period PL during which the left-eye image GL is displayed. The right-eye period PR and the left-eye period PL are alternately located on a time axis. Further, each of the frame periods F includes the first period W1, the second period W2, the third period W3, the fourth period W4 and the fifth period W5.

The right-eye period PR is a period from a start time point t1 of the fourth period W4 within a certain frame period F to a start time point t2 of the fourth period W4 within a next frame period F, and the left-eye period PL is a period from the start time point t2 of the fourth period W4 within the next frame period F to a start time point t3 of the fourth period W4 within a frame period F following the next frame period F.

Figure 12:
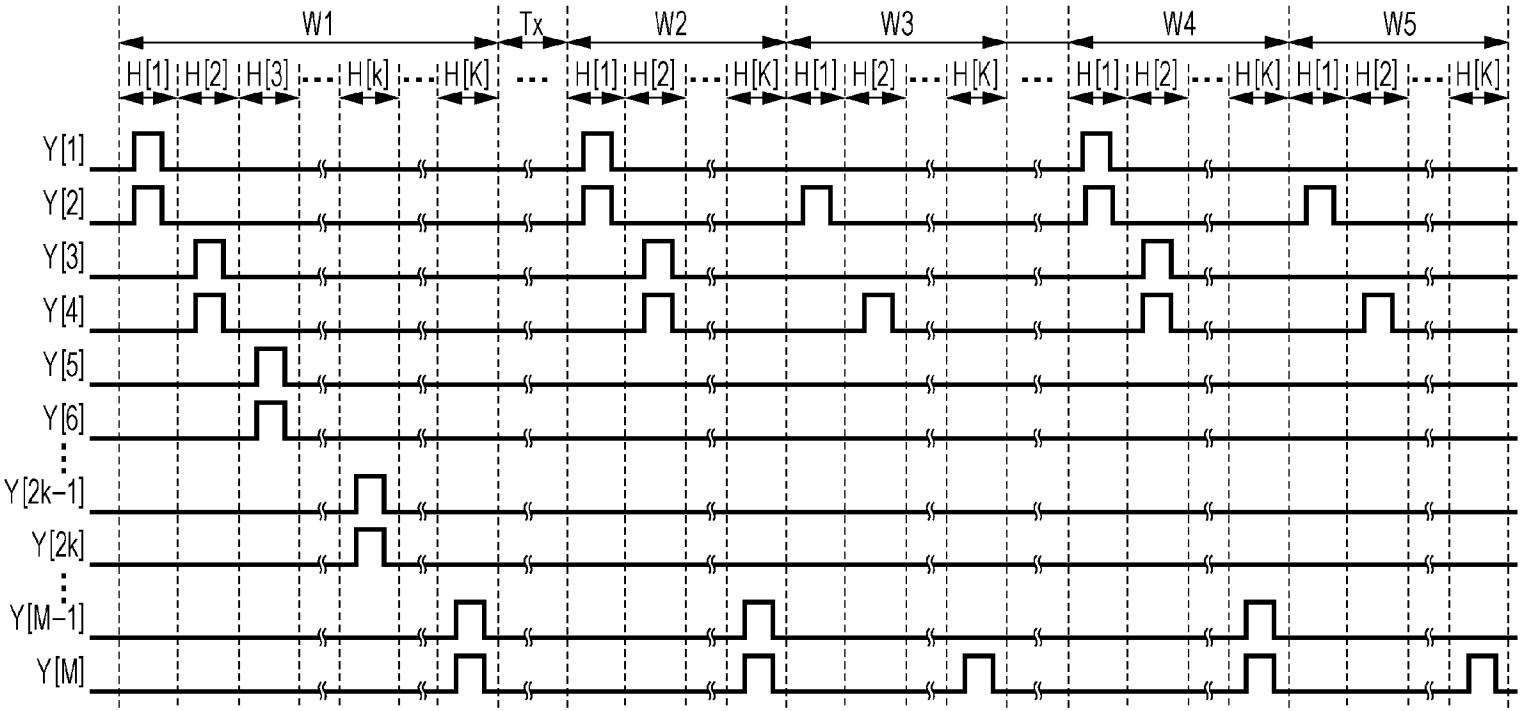
FIG. 12 is a diagram for describing operation of a scanning line drive circuit according to a fifth embodiment of the invention.

FIG. 12 is a diagram for describing operation of the scanning line drive circuit 42 during the periods W1 to W5 of each of the frame periods F. As shown in FIG. 12, during each of the first period W1, the second period W2 and the fourth period W4, the scanning line drive circuit 42 sequentially selects each of pairs of two mutually adjacent scanning lines 32 (corresponding to two rows of the pixel circuit groups B) as a selection unit during a corresponding one of the selection periods H [1] to H [K]. That is, during a k-th selection period H [k] (k is any one of natural members from 1 to K) of each of the first period W1, the second period W2 and the fourth period W4, an odd-number-th row scanning signal Y [2k−1] and an even-number-th row scanning signal Y [2k] are simultaneously set to a selection electric-potential level, and thereby, a (2k−1)th row of the scanning lines 32 (an odd-number-th row of the pixel circuit groups B) and a 2k-th row of the scanning lines 32 (an even-number-th row of the pixel circuit groups B) are simultaneously selected. Accordingly, a total number K of the selection periods H [k] within each of the first period W1, the second period W2 and the fourth period W4 corresponds to half the total number M of the scanning lines 32 (the number of rows of the pixel circuit groups B) (i.e., K=M/2).

Meanwhile, during each of the third period W3 and the fifth period W5, the scanning line drive circuit 42 sequentially selects each of even-number rows of the scanning lines 32 during a corresponding one of the selection periods H [1] to H [k]. That is, during a k-th selection period H [k] within each of the third period W3 and the fifth period W5, a scanning signal Y [2k] is set to a selection electric-potential level, and thereby, just one of the scanning lines, that is, a 2k-th row of the scanning lines 32 (a 2k-th row of the pixel circuit groups B) is selected. For example, during a selection period H [1], a 2nd row of the scanning lines 32 is selected, and during a selection period H [2], a 4th row of the scanning lines 32 is selected. Accordingly, in each of the third period W3 and the fifth period W5, K numbers (M/2 numbers) of selection periods H [1] to H [K] are included, just like the case of the first period W1.

Figure 13:
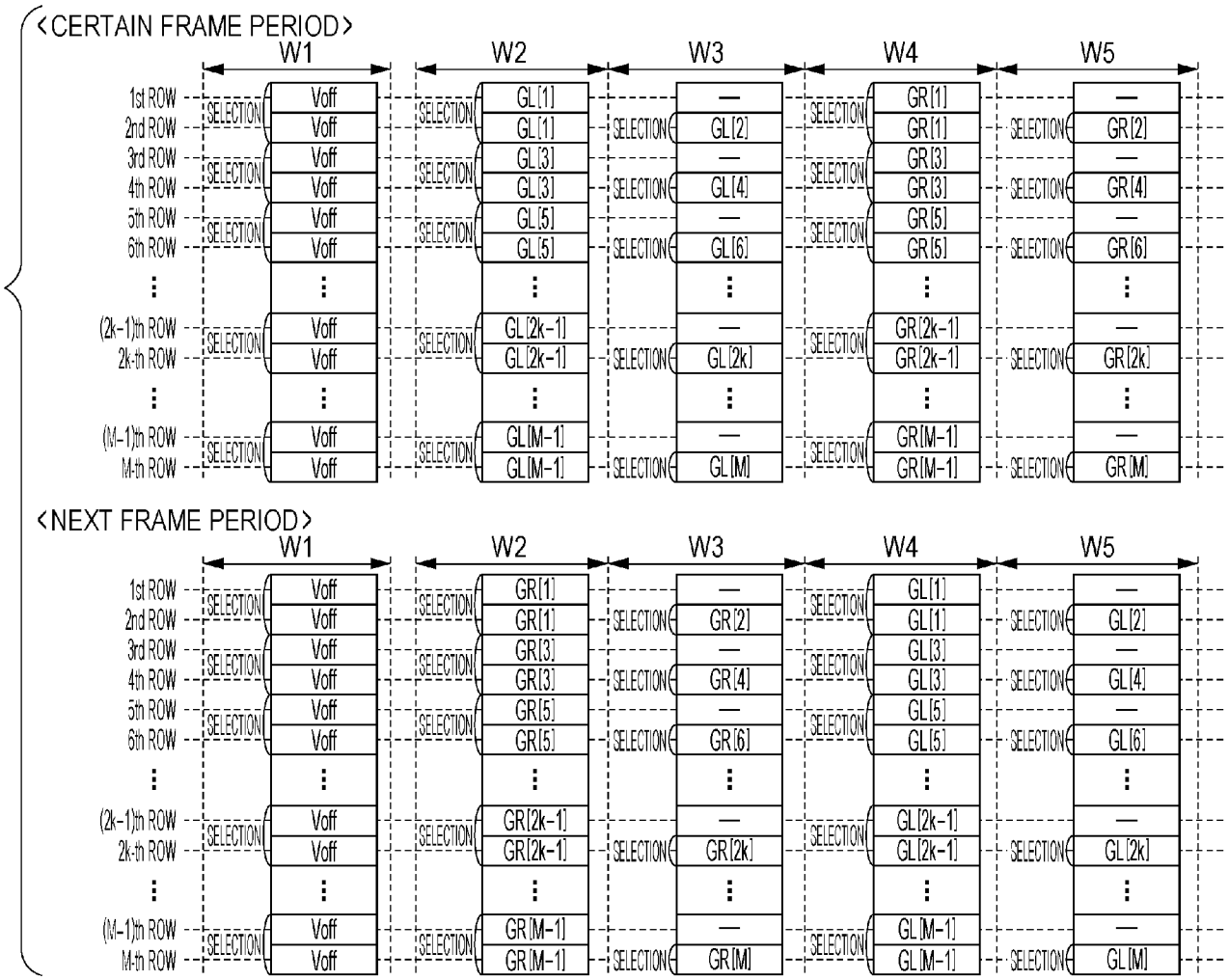
FIG. 13 is a diagram for describing operation of a drive circuit according to a fifth embodiment of the invention.

FIG. 13 illustrates operation of the data line drive circuit 44 during a first frame period and a next frame period shown in FIG. 11. During the first period W1 of each of a certain frame period and a next frame period, the off electric potential is supplied to each of the data lines 34 as a corresponding one of the data electric potentials X [1] to X [N]. As a result of this operation, a voltage applied to each of the liquid crystal element CL comes to 0 V, and even when the polarity of the common electric potential Vcom is reversed during the polarity reverse period Tx, there does not occur any situation where an excessive voltage is applied between a drain electrode and a source electrode of the transistor Tr. Further, so that the polarity of a voltage applied to each of the liquid crystal elements CL of the pixel circuits PIX after the polarity reverse period Tx becomes reverse to that before the polarity reverse period Tx, the polarity of each of the data electric potentials X [n] is reversed. Specifically, the data electric potential X [n] is set to a negative polarity (−) side relative to the common electric potential Vcom during an odd number-th frame period F (the certain frame period), and the data electric potential X [n] is set to a positive polarity (+) side relative to the common electric potential Vcom during an even number-th frame period F (the next frame period).

During the second period W2 of the certain frame period, each of pairs of an odd-number-th row and an even-number-th row is sequentially selected, and gray-scale electric potentials, which are in accordance with the left-eye image GL corresponding to the selected odd-number-th row, are simultaneously written, as data electric potentials X [n], into pixels corresponding to the simultaneously selected odd-number-th and even-number-th rows. For example, during the selection period H [1], data electric potentials X [n], which are in accordance with specified gray-scale levels GL [1] for pixels corresponding to a 1st row, are supplied to pixel circuits PIX corresponding to the 1st row and pixel circuits PIX corresponding to a 2nd row, respectively, and during the selection period H [2], data electric potentials X [n], which are in accordance with specified gray-scale levels GL [3] for pixels corresponding to a 3rd row, are supplied to the pixel circuits PIX corresponding to the 3rd row and the pixel circuits PIX corresponding to a fourth row, respectively. As described above, since any two mutually adjacent odd-number-th and even-number-th pixel circuits PIX in the y-direction are supplied with respective mutually equal data electric potentials X [n], the left-eye image GL whose resolution in the y-direction is reduced to half the original resolution is displayed on the pixel portion 30 at the time when the second period 2 ends.

Next, during the third period W3 of the certain frame period, each of even-number-th rows is sequentially selected, and gray-scale electric potentials, which are in accordance with the left-eye image GL corresponding to the selected even-number-th row, are written, as data electric potentials X [n], into pixels corresponding to the selected even-number-th row. Specifically, during the selection period H [1], data electric potentials X [n], which are in accordance with specified gray-scale levels GL [2] for respective pixels corresponding to a 2nd row, are supplied to pixel circuits PIX corresponding to the 2nd row, and during the selection period H [2], data electric potentials X [n], which are in accordance with specified gray-scale levels GL [4] for respective pixels corresponding to a 4th row, are supplied to pixel circuits PIX corresponding to the 4th row. Meanwhile, voltages applied to the liquid crystal elements CL of the respective pixel circuits PIX corresponding to odd-number-th rows are kept to voltages having been applied thereto during the immediately previous second period W2. Accordingly, the left-eye image GL having been displayed with half resolution in the y-direction at the end of the second period W2 is updated into a left-eye image GL having the originally desired resolution (M rows×N columns) at the end of the third period W3.

Next, during the fourth period W4 of the certain frame period, each of pairs of an odd-number-th row and an even-number-th row is sequentially selected, and gray-scale electric potentials, which are in accordance with the right-eye image GR corresponding to the selected odd-number-th row, are simultaneously written, as data electric potentials X [n], into pixels corresponding the simultaneously selected odd-number-th even-number-th rows. For example, during the selection period H [1], data electric potentials X [n], which are in accordance with specified gray-scale levels GR [1] for pixels corresponding to a 1st row, are supplied to pixel circuits PIX corresponding to the 1st row and pixel circuits PIX corresponding to a 2nd row, respectively, and during the selection period H [2], data electric potentials X [n], which are in accordance with specified gray-scale levels GL [3] for pixels corresponding to a 3rd row, are supplied to pixel circuits PIX corresponding to the 3rd row and pixel circuits PIX corresponding to a 4th row, respectively. As described above, since any two mutually adjacent odd-number-th and even-number-th pixel circuits PIX in the y-direction are supplied with respective mutually equal data electric potentials X [n], a right-eye image GR whose resolution in the y-direction is reduced to half the original resolution is displayed on the pixel portion 30 at the time when the fourth period 4 ends.

Next, during the fifth period W5 of the certain frame period, each of even-number-th rows is sequentially selected, and gray-scale electric potentials, which are in accordance with the right-eye image GR corresponding to the selected even-number-th row, are written, as data electric potentials X [n], into pixels corresponding to the selected even-number-th row. Specifically, during the selection period H [1], data electric potentials X [n], which are in accordance with specified gray-scale levels GR [2] for respective pixels corresponding to a 2nd row, are supplied to pixel circuits PIX corresponding to the 2nd row, and during the selection period H [2], data electric potentials X [n], which are in accordance with specified gray-scale levels GR [4] for respective pixels corresponding to a 4th row, are supplied to pixel circuits PIX corresponding to the 4th row. Meanwhile, voltages applied to liquid crystal elements CL of respective pixel circuits PIX corresponding to even-number-th rows are kept to voltages having been applied thereto during the immediately previous fourth period W4. Accordingly, the right-eye image GR having been displayed with half resolution in the y-direction at the end of the fourth period W4 is updated into a right-eye image GR having the originally desired resolution (M rows×N columns) at the end of the fifth period W5.

Further, during the second to fifth periods W2 to W5 of the next frame period, scanning lines are selected in the same methods as those of the second to fifth periods W2 to W5 of the certain frame period. In addition, with respect to images to be written, a right-eye image GR is substituted for the left-eye image GL, and a left-eye image GL is substituted for the right-eye image GR. That is, during the second period W2 of the next frame period, each of pairs of an even-number-th row and an odd-number-th row is sequentially selected, and a right-eye image GR corresponding to the selected odd-number-th row is written into pixels corresponding the selected odd-number-th and even-number-th rows. Further, during the third period W3 of the next frame period, each of even-number-th rows is sequentially selected, and a right-eye image GR corresponding to the selected even-number-th row is written into pixels corresponding to the selected even-number-th row. Further, during the fourth period W4 of the next frame period, each of pairs of an even-number-th row and an odd-number-th row is sequentially selected, and a left-eye image GL corresponding to the selected odd-number-th row is written into pixels corresponding the selected odd-number-th and even-number-th rows. Further, during the fifth period W5 of the next frame period, each of even-number-th rows is sequentially selected, and a left-eye image GL corresponding to the selected even-number-th row is written into pixels corresponding to the selected even-number-th row.

In this embodiment, the polarity reversing is performed during each of the right-eye period PR and the left-eye period PL. For example, during each of the fourth period W4 and the fifth period W5 of the certain frame period, the right-eye image GR is written with a negative polarity, and during each of the second period W2 and the third period W3 of the next frame period, the right-eye image GR is written with a positive polarity. As a result of this operation, even when the right-eye image GR and the left-eye image GL are different from each other, a direct current element of a voltage applied to each of the liquid crystal elements CL can be made zero. Moreover, a frequency for switching the right-eye image GR and the left-eye image GL can be set to a frequency higher than or equal to 60 Hz, at which flickering is unlikely to be perceived.

Furthermore, just like the case of the first embodiment, it is possible to lower a withstand voltage required for the transistor Tr along with ensuring the brightness or the contrast of a displayed image, without any shortening of a period of time necessary to perform writing into each pixel. As a result, it is possible to reduce the size of the transistor, and display images having high resolution.

6. MODIFICATION EXAMPLES

The foregoing embodiments can be modified in various manners. Specific modifications of the foregoing embodiments will be exemplified below. Two or more modifications arbitrarily selected from among the following exemplifications can be appropriately combined as far as they are not mutually contradicted.

(1) Modification Example 1

During the third period W3 of each of the above-described first to fourth embodiments, and during the third period W3 and the fifth period W5 of the above-described fifth embodiment, each of even-number-th scanning lines is sequentially selected, and an image corresponding to the selected even-number-th scanning line is written into pixels corresponding to the selected even-number-th scanning line, but, the present invention is not limited to this configuration. The configuration may be made such that, during each of the second period W2 and the fourth period W4, each of pairs of mutually adjacent odd-number-th and even-number-th scanning lines is sequentially selected, gray-scale electric potentials, which are in accordance with respective gray-scale levels, with which pixels corresponding to the selected even-number-th scanning line are to be displayed, are simultaneously written, as data electric potentials X [n], into pixels corresponding to both the selected scanning lines. Moreover, the configuration may be made such that, during each of the third period W3 and the fifth period W5, each of odd-umbers-th scanning lines is sequentially selected, gray-scale electric potentials, which are in accordance with respective gray-scale levels, with which pixels corresponding to the selected odd-number-th scanning line are to be displayed, are written, as data electric potentials X [n], into the pixels corresponding to the selected odd-number-th scanning line.

That is, the configuration may be made such that, during each of the second period W2 and the fourth period W4, each of pairs of mutually adjacent odd-number-th and even-number-th scanning lines is sequentially selected, and gray-scale electric potentials, which are in accordance with respective gray-scale levels, with which pixels corresponding to one of the selected mutually adjacent odd-number-th and even-number-th scanning lines are to be displayed, are simultaneously written, as data electric potentials X [n], into pixels corresponding to both the selected scanning lines. Moreover, the configuration may be made such that, during each of the third period W3 and the fifth period W5, each of scanning lines, which corresponds to the other one of the above mutually adjacent odd-number-th and even-number-th scanning lines, is sequentially selected, and gray-scale electric potentials, which are in accordance with respective gray-scale levels, with which pixels corresponding to the selected scanning line are to be displayed, are written, as data electric potentials X [n], into the pixels corresponding to the selected scanning line.

(2) Modification Example 2

In the above-described second embodiment, a period from the beginning of the first period W1 to the end of the second period W2 is made the first control period T1, and a period other than the first control period T1 within the frame period F is made the second control period T2, but, the invention is not limited to this configuration. The first control period T1 may be made part of or the whole of the period from the beginning of the first period W1 to the end of the second period W2, and the second control period T2 may be made a period other than the first control period T1 within the frame period F.

In the above-described fourth embodiment, a period from the beginning of the first period W1 to the end of the third period W3 is made T1, and a period other than the first control period T1 within the frame period F is made the second control period T2, but the invention is not limited to this configuration. The first control period T1 may be made part of or the whole of the period from the beginning of the first period W1 to the end of the third period W3, and the second control period T2 may be made a period other than the first control period T1 within the frame period F.

In these cases, since, during the first control period when an incomplete image is displayed, the luminance of the light source 70 is reduced as compared with the luminance during the second control period T2, it is also possible to enhance a display quality. In the modification example 2, it is preferable to adjust the luminance of the light source 70 during the second control period T2 so as to compensate the amount of light having been reduced during the first control period T1. In this case, it is possible to suppress lowering of the brightness, and at the same time, make a resolution feeling equal to that of a usual drive.

(3) Modification Example 3

In each of the above-described second and fourth embodiments, the luminance of the light source 70 is decreased (including a turning off of the light source 70) during the first control period T1, and is increased during the second control period T2. In this regard, there may be provided a configuration in which, besides such a light control mode as described above, a normal mode in which the luminance of the light source 70 is kept to constant luminance is provided, switching of these modes can be performed manually or automatically. In the normal mode, brightness is prioritized, and in the light control mode, resolution is prioritized, and thus, there may be provided a configuration in which the control circuit 14 detects a type of image and performs switching of these modes in accordance with the detected type of image. For example, the normal mode may be selected in the case of a still image, and the light control mode may be selected in the case of a moving image.

(4) Modification Example 4

In each of the above-described embodiments, during the first period W1, each of pairs of odd-number-th and even-number-th scanning lines is sequentially selected, and the off electric potential Voff is written into individual pixels corresponding to the selected scanning lines, but, the invention is not limited to this configuration. The configuration may be made such that each of groups of three or more scanning lines is sequentially selected and the off electric potential Voff is written into individual pixels corresponding to the selected scanning lines. For example, all scanning lines are selected at one time, and the off electric potential Voff is written into individual pixels corresponding to the all scanning lines. Moreover, the configuration may be made such that, in each of the pixels PIX, a transistor, for which one of drain and source electrodes is connected to the pixel electrode 62, and the other one of the drain and source electrodes is supplied with the common electric potential Vcom, is provided, and the off electric potential Voff is written into each of all the pixels PIX by turning on the relevant transistor of the each of all the pixels PIX.

7. Application Example

The electro-optic apparatus 100A, 100B or 100C exemplified in the individual aforementioned embodiments can be utilized in various electronics devices. In FIG. 14 to FIG. 18, specific embodiments of electronics devices each employing the liquid crystal display apparatus 10 are exemplified.

Figure 14:
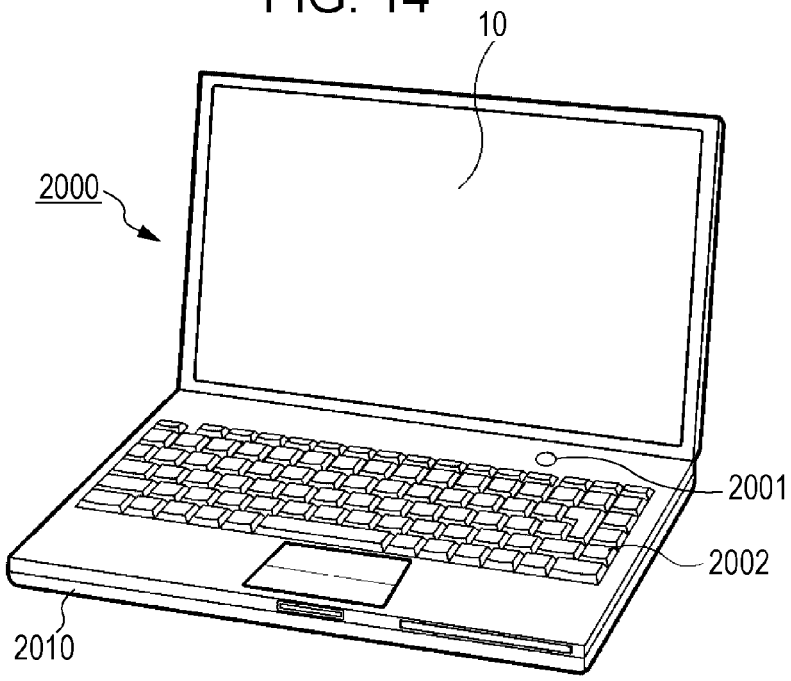
FIG. 14 is a perspective view of an electronics device (a personal computer).

FIG. 14 is a perspective view of a portable personal computer employing the electro-optic apparatus 10. A personal computer 2000 includes the electro-optic apparatus 10 for displaying various images, and a body 2010 on which a power on/off switch 2001, a key board 2002 and the like are mounted.

Figure 15:
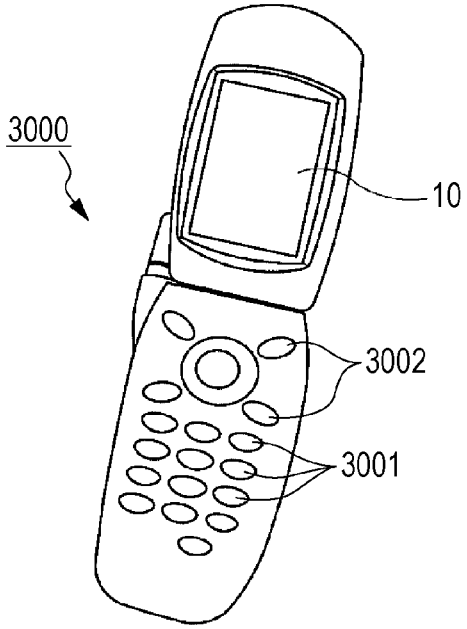
FIG. 15 is a perspective view of an electronics device (a mobile telephone).

FIG. 15 is a perspective view of a mobile telephone to which the electro-optic apparatus 10 is applied. A mobile telephone 3000 includes a plurality of operation buttons 3001, scroll buttons 3002, and the electro-optic apparatus 10 for displaying various images. An image displayed on the electro-optic apparatus 10 is scrolled by operating the scroll buttons 3002.

Figure 16:
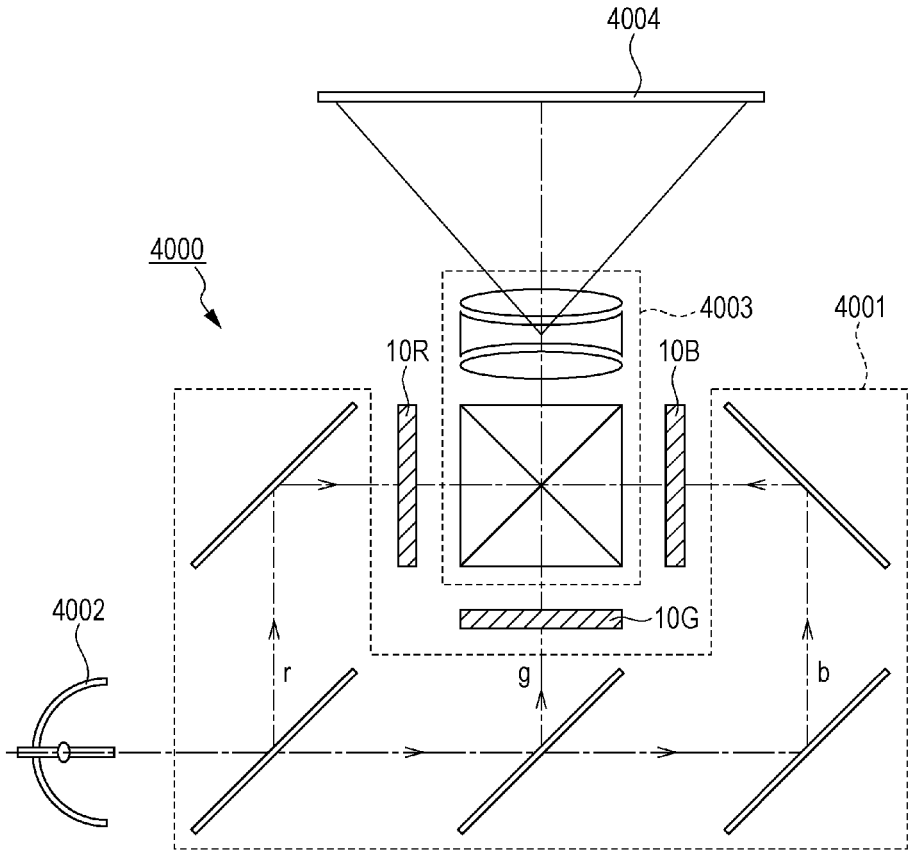
FIG. 16 is a perspective view of an electronics device (a projection type display apparatus).
Figure 17A:
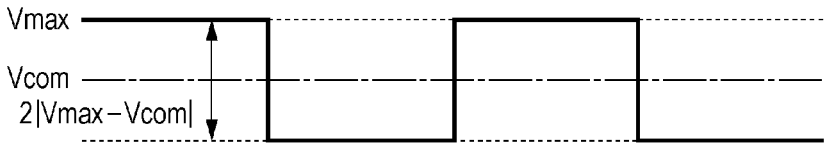
FIG. 17A and FIG. 17B are diagrams for describing a withstand voltage of a transistor included in a pixel in an existing technology.
Figure 17B:
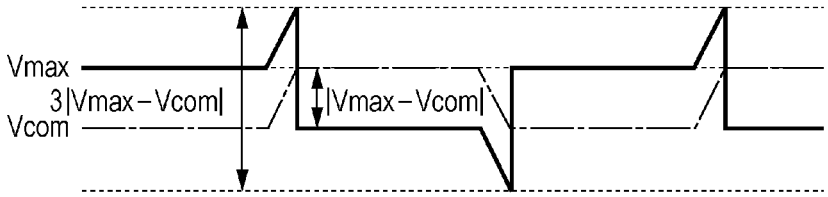

FIG. 16 is a schematic block diagram of a projection type display apparatus (a three-plate type projector) 4000 to which the electro-optic apparatus 10 is applied. This projection type display apparatus 4000 is configured to include three number of the electro-optic apparatuses 10 (10R, 10G and 10B) corresponding to respective mutually different display colors (a red color, a green color and a blue color). An illumination optic system 4001 supplies a red color element r, a green color element g and a blue color element b of light irradiated from a luminance apparatus (a light source) 4002 to the electro-optic apparatus 10R, the electro-optic apparatus 10G and the electro-optic apparatus 10B, respectively. The electro-optic apparatuses 10 function as respective light modulators (light valves) for modulating corresponding single color light rays supplied from the illumination optic system 4001 in accordance with an image to be displayed. A projection optic system 4003 combines light rays irradiated from the respective electro-optic apparatuses 10 and projects a stereoscopic image resulting from the combination on a projection face 4004. An observer views the stereoscopic image projected on the projection face 4004 through the piece of stereoscopic spectacles 20.

In addition, known examples of an electronics device, to which an electro-optic apparatus according to aspects of the inventions is applied, include, besides the electronics devices exemplified in FIGS. 14 to 16, a portable information terminal (a personal digital assistants (PDA)), a digital still camera, a television set, a video camera, a car navigation device, a vehicle built-in display device (an instrument panel), an electric notebook, electric paper, an electric calculator, a word processor, a workstation, a picture telephone, a POS terminal, a printer, a scanner, a copying machine, a video player, a device equipped with a touch panel, and the like.

The entire disclosure of Japanese Patent Application No. 2012-207892, filed Sep. 21, 2012 is expressly incorporated by reference herein.

What is claimed is:

1. An electro-optic apparatus that displays an image for each frame period including a first period, a second period following the first period, and a third period following the second period, the electro-optic apparatus comprising:

a plurality of scanning lines;

a plurality of data lines;

a plurality of pixels each being provided so as to correspond to one of intersections of the plurality of scanning lines and the plurality of data lines;

a drive circuit configured to, in synchronization with a selection of one scanning line of the plurality of scanning lines, supply data electric potentials to respective pixels, which are included in the plurality of pixels and which correspond to the selected one scanning line, via the plurality of data lines; and a common electric potential supply circuit configured to reverse a polarity of a common electric potential supplied to a common electrode relative to a reference electric potential, wherein each of the plurality of pixels includes a pixel electrode, the common electrode which is supplied with the common electric potential, liquid crystal which is driven between the pixel electrode and the common electrode, and a transistor which electrically connects the pixel electrode and one data line of the plurality of data lines in response to the selection of one scanning line of the plurality of scanning lines, wherein the drive circuit is configured to, during the first period, sequentially select each of pairs of two mutually adjacent odd-number-th and even-number-th scanning lines among the plurality of scanning lines, and simultaneously write, as the data electric potential, an off electric potential into pixels corresponding to both the selected scanning lines;

during the second period, sequentially select each of pairs of two mutually adjacent odd-number-th and even-number-th scanning lines among the plurality of scanning lines, and simultaneously write, as the data electric potentials, gray-scale electric potentials, which are in accordance with respective gray-scale levels with which pixels corresponding to one scanning line of the selected two mutually adjacent odd-number-th and even-number-th scanning lines are to be displayed, into pixels corresponding to both the selected scanning lines; and during the third period, sequentially select each of scanning lines which are among the plurality of scanning lines and which each correspond to the other one scanning line of the two mutually adjacent odd-number-th and even-number-th scanning lines, and write, as the data electric potentials, gray-scale electric potentials, which are in accordance with respective gray-scale levels with which pixels corresponding to the selected scanning line are to be displayed, into the pixels corresponding to the selected scanning line, and wherein the common electric potential supply circuit reverses the polarity of the common electric potential during a period between an end of the first period and a beginning of the second period.

2. The electro-optic apparatus according to claim 1, further comprising:

a light source configured to irradiate the plurality of pixels with light; and a control circuit configured to perform control of luminance of the light source, wherein, in the case where part of or a whole of a period from a beginning of the first period to an end of the second period is made a first control period, and a period other than the first control period within the frame period is made a second control period, the control circuit performs control of the light source so as to make luminance of the light which is irradiated to the pixels during the first control period lower as compared with that during the second control period.

3. The electro-optic apparatus according to claim 2, wherein the control circuit is capable of performing switching between a normal mode in which the luminance of the light source is kept to constant luminance, and a light control mode in which the luminance of the light source is adjusted so as to be different between the first control period and the second control period.

4. An electronics device comprising the electro-optic apparatus according to claim 3.

5. An electronics device comprising the electro-optic apparatus according to claim 2.

6. The electro-optic apparatus according to claim 1, wherein the frame period further includes a fourth period, and during the fourth period, the drive circuit sequentially selects each of the plurality of scanning lines, and writes, as the data electric potentials, gray-scale electric potentials, which are in accordance with respective gray-scale levels with which pixels corresponding to the selected scanning line are displayed, into the pixels corresponding to the selected scanning line.

7. The electro-optic apparatus according to claim 6, further comprising:

a light source configured to irradiate the plurality of pixels with light; and a control circuit configured to perform control of luminance of the light source, wherein, in the case where part of or a whole of a period from a beginning of the first period to an end of the third period is made a first control period, and a period other than the first control period within the frame period is made a second control period, the control circuit performs control of the light source so as to make luminance of the light which is irradiated to the pixels during the first control period lower as compared with that during the second control period.

8. An electronics device comprising the electro-optic apparatus according to claim 7.

9. An electronics device comprising the electro-optic apparatus according to claim 6.

10. The electro-optic apparatus according to claim 1, wherein the frame period further includes a fourth period and a fifth period, wherein a right-eye image and a left-eye image, which are stereoscopic through a pair of stereoscopic spectacles including a right-eye shutter and a left-eye shutter, are displayed, and a spectacles control circuit for controlling the left-eye shutter and the right-eye shutter is provided, wherein the drive circuit is configured to, during the fourth period, sequentially select each of pairs of two mutually adjacent odd-number-th and even-number-th scanning lines among the plurality of scanning lines, and simultaneously write, as the data electric potentials, gray-scale electric potentials, which are in accordance with respective gray-scale levels with which pixels corresponding to one scanning line of the selected two mutually adjacent odd-number-th and even-number-th scanning lines are to be displayed, into pixels corresponding to both the selected scanning lines; and during the fifth period, sequentially select each of scanning lines which are among the plurality of scanning lines and which each correspond to the other one scanning line of the two mutually adjacent odd-number-th and even-number-th scanning lines, and write, as the data electric potentials, gray-scale electric potentials, which are in accordance with respective gray-scale levels with which pixels corresponding to the selected scanning line are to be displayed, into the pixels corresponding to the selected scanning line, wherein the gray-scale electric potentials written into the pixels during each of the second period and the third period are gray-scale electric potentials for one of the right-eye image and the left-eye image, and the gray-scale electric potentials written into the pixels during each of the fourth period and the fifth period are gray-scale electric potentials for the other one of the right-eye image and the left-eye image, and wherein the spectacles control circuit causes one shutter of the right-eye shutter and the left-eye shutter to transit from a closed state to an open state at a beginning of the fifth period of a certain frame period, and transit from the open state to the closed state at a beginning of the fourth period of a next frame period, and causes the other one shutter of the right-eye shutter and the left-eye shutter to transit from an open state to a closed state at a beginning of the fourth period of the certain frame period, and transit from the closed state to the open state at a beginning of the fifth period of the next frame period.

11. An electronics device comprising the electro-optic apparatus according to claim 1.

12. A driving method for an electro-optic apparatus that displays an image for each frame period including a first period, a second period following the first period, and a third period following the second period, and that includes a plurality of scanning lines, a plurality of data lines, and a plurality of pixels, each being provided so as to correspond to one of intersections of the plurality of scanning lines and the plurality of data lines, and including a pixel electrode, a common electrode which is supplied with a common electric potential, liquid crystal which is driven between the pixel electrode and the common electrode, and a transistor which electrically connects the pixel electrode and one data line of the plurality of data lines in response to a selection of one scanning line of the plurality of scanning lines, the driving method comprising:

during the first period, sequentially selecting each of pairs of two mutually adjacent odd-number-th and even-number-th scanning lines among the plurality of scanning lines, and simultaneously writing, as a data electric potential, an off electric potential into pixels corresponding to the selected scanning lines;

during a period between an end of the first period and a beginning of the second period, reversing a polarity of the common electric potential;

during the second period, sequentially selecting each of pairs of two mutually adjacent odd-number-th and even-number-th scanning lines among the plurality of scanning lines, and simultaneously writing, as data electric potentials, gray-scale electric potentials, which are in accordance with respective gray-scale levels with which pixels corresponding to one scanning line of the selected two mutually adjacent odd-number-th and even-number-th scanning lines are to be displayed, into pixels corresponding to the selected scanning lines; and during the third period, sequentially selecting each of scanning lines which are among the plurality of scanning lines and which each correspond to the other one scanning line of the two mutually adjacent odd-number-th and even-number-th scanning lines, and writing, as data electric potentials, gray-scale electric potentials, which are in accordance with respective gray-scale levels with which pixels corresponding to the selected scanning line are to be displayed, into the pixels corresponding to the selected scanning line.

* * * * *